US009738101B2

(12) United States Patent
Matsumoto et al.

(10) Patent No.: US 9,738,101 B2
(45) **Date of Patent: *Aug. 22, 2017**

(54) PRINTING SYSTEM, PRINTING APPARATUS, AND PRINTED-MATTER PRODUCTION METHOD

(71) Applicant: RICOH COMPANY, LTD., Tokyo (JP)

(72) Inventors: Hiroyoshi Matsumoto, Kanagawa (JP); Junji Nakai, Kanagawa (JP); Masakazu Yoshida, Kanagawa (JP); Toshitaka Osanai, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/008,727

(22) Filed: Jan. 28, 2016

(65) Prior Publication Data

US 2016/0159108 A1 Jun. 9, 2016

Related U.S. Application Data

(63) Continuation of application No. 14/332,777, filed on Jul. 16, 2014, now Pat. No. 9,278,548.

(30) Foreign Application Priority Data

Jul. 31, 2013 (JP) ..... 2013-159979
Jun. 6, 2014 (JP) ..... 2014-117324

(51) Int. Cl.
*B41M 5/00* (2006.01)
*B41M 7/00* (2006.01)
*B41J 11/00* (2006.01)

(52) U.S. Cl.
CPC ..... *B41M 7/0045* (2013.01); *B41J 11/0015* (2013.01); *B41M 5/0011* (2013.01); *B41M 5/0017* (2013.01); *B41M 7/0072* (2013.01)

(58) Field of Classification Search
CPC B41M 7/0045; B41M 7/0072; B41M 5/0011; B41M 5/0017; B41J 11/0015
See application file for complete search history.

(56) References Cited

U.S. PATENT DOCUMENTS 9,278,548 B2 * 3/2016 Matsumoto ..... B41M 5/0011
2004/0104988 A1 * 6/2004 Sawada ..... B41M 5/0017 347/101

(Continued)

FOREIGN PATENT DOCUMENTS

JP 2008-009379 1/2008
JP 2008-169242 7/2008

(Continued)

OTHER PUBLICATIONS

Araki et al., "Development of a UV Inkjet System for Printing Flexible Packaging", *Fujifilm Research & Development*, Dec. 7, 2015, No. 61-2016, pp. 13-17.

*Primary Examiner* — Manish S Shah
*Assistant Examiner* — Yaovi M Ameh
(74) *Attorney, Agent, or Firm* — Oblon, McClelland, Maier & Neustadt, L.L.P.

(57) ABSTRACT

According to an aspect of the present invention, a printing apparatus includes a plasma treatment unit configured to acidify at least a surface of a print medium by applying plasma treatment to the surface of the print medium, a first primer applying unit configured to apply primer treatment by applying treatment liquid to the surface of the print medium having undergone the plasma treatment, and a first recording unit configured to perform recording by inkjet recording on the print medium having undergone the primer treatment.

36 Claims, 13 Drawing Sheets

(56) References Cited

U.S. PATENT DOCUMENTS

| | | | | |
|---|---|---|---|---|
| 2007/0046720 | A1 | 3/2007 | Konno et al. | |
| 2007/0224394 | A1* | 9/2007 | Takeyama | C08J 7/18 428/141 |
| 2008/0044192 | A1 | 2/2008 | Yagawara et al. | |
| 2009/0290007 | A1* | 11/2009 | Saitoh | B41J 11/0015 347/102 |
| 2010/0171784 | A1 | 7/2010 | Kitawaki et al. | |
| 2010/0226958 | A1 | 9/2010 | Khoury et al. | |
| 2011/0249055 | A1* | 10/2011 | Sasada | C09D 11/101 347/20 |
| 2011/0292103 | A1 | 12/2011 | Hatakeyama et al. | |
| 2012/0007067 | A1* | 1/2012 | Kaneta | H01L 51/5206 257/40 |
| 2012/0020706 | A1 | 1/2012 | Yoshida et al. | |
| 2012/0082795 | A1 | 4/2012 | Verardi et al. | |
| 2012/0194590 | A1 | 8/2012 | Suzuki | |
| 2013/0025483 | A1 | 1/2013 | Gila et al. | |
| 2013/0250017 | A1* | 9/2013 | Saitoh | C08J 7/00 347/101 |
| 2014/0078212 | A1 | 3/2014 | Nakai et al. | |

FOREIGN PATENT DOCUMENTS

| | | |
|---|---|---|
| JP | 2009-279796 | 12/2009 |
| JP | 2010-058404 | 3/2010 |
| JP | 2010-188568 | 9/2010 |
| JP | 2013-006308 | 1/2013 |

* cited by examiner

PRINTING SYSTEM, PRINTING APPARATUS, AND PRINTED-MATTER PRODUCTION METHOD

CROSS-REFERENCE TO RELATED APPLICATIONS

This application is a continuation of and claims the benefit of priority from U.S. Ser. No. 14/332,777, filed Jul. 16, 2014, which claims the benefit of priority from Japanese Patent Application No. 2013-159979 filed, Jul. 31, 2013 and Japanese Patent Application No. 2014-117324 filed, Jun. 6, 2014, the entire contents of each of which are incorporated herein by reference.

BACKGROUND OF THE INVENTION

1. Field of the Invention

The present invention relates generally to printing systems, printing apparatuses, and printed-matter production methods.

2. Description of the Related Art

"Shuttle-head" design is presently in mainstream of inkjet recording. However, because shuttle-head printing poses difficulty in increasing printing speed, "single-pass" design using a full-page-width line head is proposed for high-speed printing. Although the single-pass design advantageously increases the printing speed, a printer of the single-pass design ejects adjacent dots with a short interval of time. Accordingly, a second one of adjacent dots is ejected before ink of a first one, which is ejected earlier, of the adjacent dots penetrates into a print medium. Consequently, coalescence of the adjacent dots (hereinafter, sometimes referred to as "droplet interference") can occur, which may result in degradation in image quality due to occurrence of beading or bleed.

Furthermore, in a situation where an inkjet printing apparatus prints an image on an impermeable medium or a low-permeable medium such as a film or coated paper, another problem can occur. That is, migration and coalescence of adjacent dots may cause an image defect such as beading or bleed.

Conventionally, to avoid such a problem which can occur in printing on a film or coated paper, reducing printing speed, adding a drier unit, or a like strategy is adopted. Meanwhile, existing methods for improving fixation of water-based ink onto a print medium include a method of applying primer to the print medium in advance.

As another method for improving fixation of water-based ink onto a print medium, a method of applying plasma treatment onto a surface of the print medium is proposed, for example, in Japanese Laid-open Patent Publication No. 2010-058404. It is known that applying plasma treatment onto a surface of a print medium increases hydrophilicity of the surface. Accordingly, plasma treatment application can improve hydrophilicity and wettability of coated paper which is generally poor in wettability. Plasma treatment provides another advantage that, because of being a dry process, plasma treatment does not require a drying step.

However, the method of applying a primer can disadvantageously increase printing cost with some types of print media. The reasons therefor are the following: the primer applied as pretreatment liquid is a consumable; a device and a step for drying the primer are required. The method of applying plasma treatment can be disadvantageous in terms of safety, size of printing apparatus, and cost. This is because application of plasma treatment to some types of print media requires high-voltage plasma.

Accordingly, there is a need for systems, apparatuses, and printed-matter production methods configured to be capable of optimizing pretreatment according to a type of a print medium.

It is an object of the present invention to at least partially solve the problem in the conventional technology.

SUMMARY OF THE INVENTION

It is an object of the present invention to at least partially solve the problems in the conventional technology.

According to the present invention, there is provided a printing apparatus comprising: a plasma treatment unit configured to acidify at least a surface of a print medium by applying plasma treatment to the surface of the print medium; a first primer applying unit configured to apply primer treatment by applying treatment liquid to the surface of the print medium having undergone the plasma treatment; and a first recording unit configured to perform recording by inkjet recording on the print medium having undergone the primer treatment.

The present invention also provides a printing system comprising: a plasma treatment device configured to acidify at least a surface of a print medium by applying plasma treatment to the surface of the print medium; a primer applying device configured to apply primer treatment by applying treatment liquid to the surface of the print medium having undergone the plasma treatment; and a recording device configured to perform recording by inkjet recording on the print medium having undergone the primer treatment.

The present invention also provides a method for producing a printed matter, the printed matter being a print medium on which an image is formed by inkjet recording, the method comprising: applying plasma treatment to a surface of the print medium to thereby acidify at least the surface of the print medium; applying primer treatment by applying treatment liquid to the surface of the print medium having undergone the plasma treatment; and performing recording by inkjet recording on the print medium having undergone the primer treatment.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Preferred embodiments of the present invention are described in detail below with reference to the accompanying drawings. Although the presently preferred embodiments of the present invention are described below with various technically preferred limitations, the scope of the invention should not be construed as limited by the embodiments discussed below. It should not be construed that all of elements of the embodiments discussed below are essential to the invention.

Figure 1:
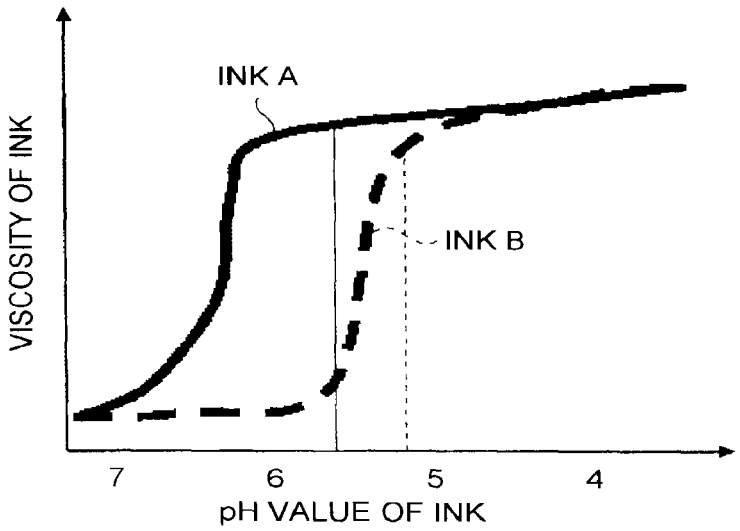
FIG. 1 is a graph illustrating relationship between viscosity and pH value of inks according to an embodiment of the present invention.

In an embodiment herein, appropriate one of acidification treatment, primer treatment, and combination thereof is applied to a print medium as pretreatment. Meanwhile, "acidification" in the following description denotes lowering a pH value of a surface of a print medium to a pH value at which pigments contained in ink coagulate. FIG. 1 illustrates an example of relationship between viscosity and pH value of inks. As illustrated in FIG. 1, the lower the pH value of ink, the higher the viscosity of the ink. This is because the higher the acidity of the ink, the more pigments, which are negatively charged in ink vehicle, in the ink are neutralized; as a result, the pigments gradually coagulate. Accordingly, the viscosity of the ink can be increased by, for example, lowering the pH value of the surface of the print medium so that the pH value of the ink reaches a value corresponding to a desired viscosity in the graph illustrated in FIG. 1. This is because, when ink is deposited on an acid surface of a print medium, pigments in ink are neutralized by hydrogen ions (H+) on the surface of the print medium; as a result, the pigments coagulate. This coagulation allows preventing color mixing of adjacent dots and, simultaneously, preventing the pigments from penetrating deep to the interior (or even to the backside) of the print medium. Note that to lower pH value of the ink to a pH value corresponding to a desired viscosity, it is necessary to lower pH value of the surface of the print medium to a value lower than the pH value of the ink corresponding the desired viscosity.

Meanwhile, pH value at which ink has the desired viscosity depends on property of the ink. More specifically, as in the case of ink A illustrated in FIG. 1, pigments of ink of some types coagulate and increase viscosity of the ink at a pH value relatively close to a neutral value. However, as in the case of ink B which differs from the ink A in property, ink of some other types requires a pH value lower than the pH value of the ink A to cause pigments in the ink to coagulate. In an embodiment herein, appropriate one of acidification treatment, primer treatment, and combination thereof is applied according to type of a print medium with consideration given to property (e.g., type) of ink.

Examples of acidification treatment according to the embodiment include plasma treatment which is performed by exposing a subject to plasma in the air atmosphere. The plasma treatment as the acidification treatment is applied by exposing a subject (for example, a print medium) to plasma in the air atmosphere to cause polymers on a surface of the print medium to react, thereby forming hydrophilic functional groups. More specifically, electrons (e) emitted from discharge electrodes are accelerated in an electric field to excite and ionize atoms and molecules in the atmospheric gas. The ionized atoms and molecules also emit electrons, whereby the number of high-energy electrons is increased, and streamer discharge (plasma) is formed. The high-energy electrons produced by the streamer discharge break bonding of the polymers on the surface of the print medium (e.g., coated paper) (coating layer of the coated paper is bound with calcium carbonate and starch; the starch serving as a binder has a polymer structure) and recombine with oxygen radicals (O*), hydroxyl radicals (*OH), and ozone $O_3$ in the gas. This series of processing is referred to as "plasma treatment". The plasma treatment forms polar functional groups, such as hydroxyl groups and carboxyl groups, on the surface of the print medium. As a result, hydrophilicity and acidity are imparted to the surface of the print medium. Meanwhile, the surface of the print medium is acidified (i.e., the pH value of the surface is lowered) by the increase in the carboxyl groups.

The increased hydrophilicity makes adjacent dots on the surface of the print medium wet and spread, causing the dots to coalesce together. To prevent color mixing between dots, which can be caused by such coalescence, it is desired to coagulate colorants (e.g., pigments or dyes) in each dot immediately, or to dry ink vehicle or cause the ink vehicle to penetrate into the print medium before the vehicle becomes wet and spread. The plasma treatment described above can accelerate coagulation of colorants in each dot; this is because the plasma treatment also acts as the acidification procedure (process) which acidifies the surface of the print medium. Also in this respect, it will be advantageous to apply the plasma treatment as pretreatment of inkjet recording.

Meanwhile, it is possible to apply an acidic treatment liquid referred to as a primer to a surface of a print medium, thereby imparting a greater affinity for alkaline ink. The reason for this is presumably that polymeric material contained in the treatment liquid is trapped in pore structure of the print medium and prevents excessive penetration of the ink into the print medium. Accordingly, the primer treatment is particularly effective for highly-permeable print media, examples of which include ordinary paper, coarse paper, and thin paper. However, because a certain application amount (coating thickness) of the treatment liquid is required to apply the treatment liquid uniformly, the primer treatment can lead to an increase in cost.

In an embodiment herein, an inkjet recording apparatus, which is employed as an example of a printing apparatus, is configured to use combination of exposing a print medium to plasma in the atmosphere and primer treatment according to type of the print medium in pretreatment. Using the combination allows reducing energy necessary for the plasma exposure and reducing an application amount of primer while maintaining quality of the print image. The printing apparatus according to the embodiment is not limited to an inkjet recording apparatus, and can be a printing apparatus, an image forming apparatus, or the like which uses ink in other fashion.

Meanwhile, behavior of ink in inkjet recording varies with droplet volume (small droplet, medium droplet, or large droplet) and type of a print medium. In an embodiment herein, plasma energy density for plasma exposure is adjusted to an appropriate value according to type of a print medium and a print mode (droplet volume). More specifically, wettability of the print medium and a pH of the surface of the print medium are measured, and the plasma energy density is optimized according to the measured values. Furthermore, the pretreatment is controlled differently depending on the print medium to which the pretreatment is to be applied. This configuration allows applying pretreatment optimized according to the print medium.

In an embodiment hereinafter, an inkjet-recording image forming apparatus is configured to switch a conveyance route of a print medium so that the print medium undergoes effective one or both of atmospheric plasma treatment and primer treatment, which applies treatment liquid to the surface of the print medium, before an image is recorded on the print medium. This configuration allows reducing load imposed on units for the respective pretreatments, thereby achieving energy saving and increasing usable lives. An embodiment may be configured to detect at least one of wettability and a pH of the surface of the print medium and optimize outputs of the respective treatment units based on a detected value(s).

An embodiment of the present invention is described in detail below with reference to the accompanying drawings. In the embodiment, as pretreatment to be applied by an inkjet recording apparatus to a print medium, combination of exposing the print medium to plasma in the atmosphere and applying a primer to the print medium is employed. The inkjet recording apparatus can reduce an amount (hereinafter, "application amount") of the primer to be applied while reducing energy necessary for the plasma treatment regardless of whether the print medium has low permeability or high permeability by employing the combination of the plasma treatment and the primer treatment. As a result, because ink consumption can be reduced while simultaneously reducing time and energy necessary for drying the treatment liquid (the primer), the inkjet recording apparatus is capable of producing a printed matter of high quality while achieving energy saving and low CPP (cost reduction).

Figure 2:
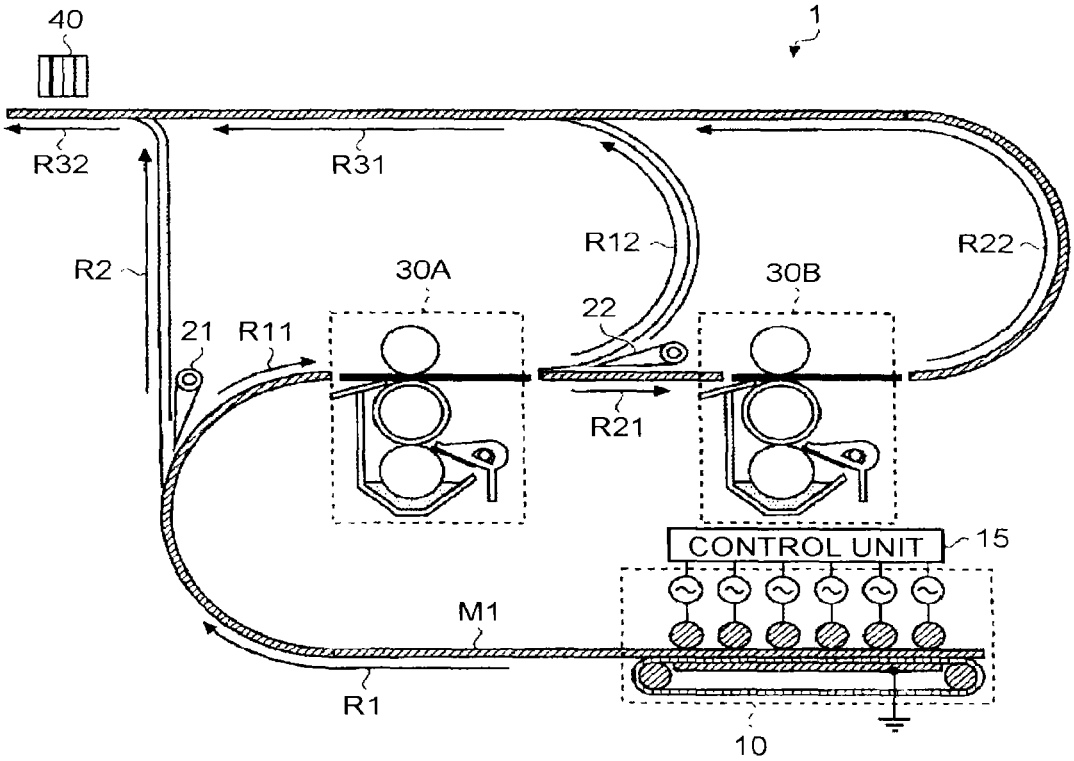
FIG. 2 is a diagram illustrating a schematic configuration of an inkjet recording apparatus according to the embodiment.

FIG. 2 is a diagram illustrating a schematic configuration of an inkjet recording apparatus according to the embodiment. Referring to FIG. 2, an inkjet recording apparatus 1 includes an acidification unit 10, a control unit 15, a first primer applying unit 30A, a second primer applying unit 30B, and an inkjet recording unit 40.

The inkjet recording apparatus 1 further includes, as conveyance routes of a print medium M1, a first route, a second route, and a third route. The first route includes conveyance paths R1, R2, and R32. The second route includes the conveyance path R1, conveyance paths R11, R12, and R31, and the conveyance path R32. The third route includes the conveyance paths R1 and R11, conveyance paths R21, R22, and R31, and the conveyance path R32. The acidification unit 10 is arranged on the conveyance path R1 included in the first to third routes. The first primer applying unit 30A is arranged, for example, on the conveyance path R11 included in the second and third routes. The second primer applying unit 30B is arranged, for example, on the conveyance path R21 included in the third route. The inkjet recording unit 40 is arranged on the conveyance path R32 included in the first to third routes. The inkjet recording apparatus 1 further includes conveyance switch units 21 and 22 for switching between routes along which the print medium M1 is to be conveyed. The conveyance switch unit 21 switches the conveyance route of the print medium M1 between the first route and the second route, for example. The conveyance switch unit 22 switches the conveyance route of the print medium M1 between the second route and the third route, for example. The conveyance switch units 21 and 22 may be controlled by, for example, a control unit (not shown). More specifically, the embodiment allows selecting which one of only the plasma treatment, the plasma treatment and a single cycle of the primer treatment, and the plasma treatment and two cycles of the primer treatment, is to be applied to the print medium M1 by switching to any one of the first to third routes according to the type of the print medium M1. The inkjet recording apparatus 1 may be configured to apply a single cycle or multiple cycles of the primer treatment without applying the plasma treatment. The inkjet recording apparatus 1 may be configured to, when operating as such, cut off power supply to the acidification unit 10 or cut off power supply to discharge electrodes of the acidification unit 10.

The inkjet recording apparatus 1 may be configured as follows. In a situation where the print medium M1 is an impermeable medium, for example, the plasma treatment is applied to the print medium M1 first. If the surface of the print medium M1 has been modified by the plasma treatment sufficiently, the print medium M1 is conveyed to the inkjet recording unit 40 without passing through the primer applying units 30A and 30B. In a case where the plasma treatment and a single cycle of the primer treatment are insufficient to modify the surface of the print medium M1, the conveyance switch units 21 and 22 are controlled so as to convey the print medium M1 to the third route along which two cycles of the primer treatment are applied by the primer applying units 30A and 30B. In a case where it is unnecessary to apply the plasma treatment, the print medium M1 is conveyed along the conveyance path R1 without receiving the plasma treatment from the acidification unit 10.

The embodiment is thus configured so as to apply pretreatment differently as to whether or not to apply the plasma treatment and in the amount of the treatment liquid to be applied to the print medium M1. Driers (not shown) for drying the treatment liquid before printing is performed by the inkjet recording unit 40 are arranged on the corresponding conveyance paths at positions immediately downstream of the primer applying units 30A and 30B, respectively.

By switching the conveyance route of the print medium M1 in this way, unnecessary driving of one or more of the primer applying units can be obviated. Accordingly, load required of a system including the inkjet recording apparatus 1 to drive the primer applying units 30A and 30B can be reduced. As a result, energy saving and increasing usable lives of components can be achieved. Furthermore, whether or not to drive the acidification unit 10 is also selectable as necessary. Accordingly, load required of the system to drive the acidification unit 10 can be reduced, and energy saving and increasing usable lives of components can be achieved similarly.

Figure 3:
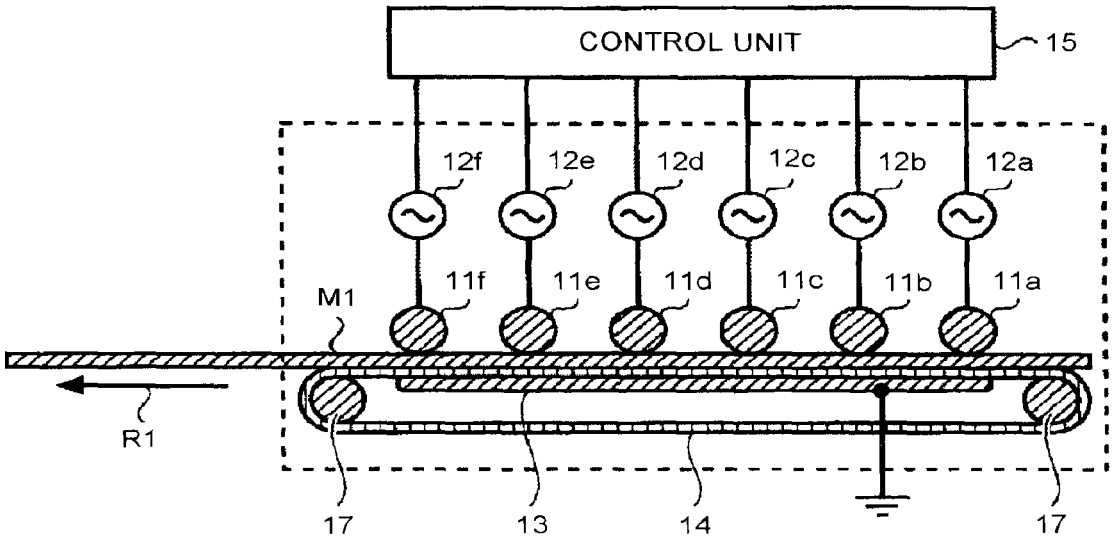
FIG. 3 is a diagram illustrating a schematic configuration of an acidification unit illustrated in FIG. 2.

FIG. 3 is a diagram illustrating a schematic configuration of the acidification unit 10 illustrated in FIG. 2. The acidification unit 10 according to the embodiment may be, for example, an atmospheric-pressure non-equilibrium plasma treatment device which utilizes dielectric barrier discharge. Referring to FIG. 3, the acidification unit 10 includes multiple discharge electrodes, denoted by 11*a* to 11*f*, arranged along the conveyance path R1; high-voltage high-frequency power supplies 12*a* to 12*f* configured to apply discharge voltages to the discharge electrodes 11*a* to 11*f*; a ground electrode 13; a dielectric 14, which is an endless belt, interposed between the discharge electrodes 11*a* to 11*f* and the ground electrode 13; and rollers 17 configured to cause the dielectric 14 to revolve along the conveyance path R1. The print medium M1 is plasma-treated on the way of being conveyed along a conveyance path R1. The discharge voltages respectively applied by the high-voltage high-frequency power supplies 12*a* to 12*f* to the corresponding discharge electrodes 11*a* to 11*f* may be controlled by, for example, the control unit 15.

Figure 7:
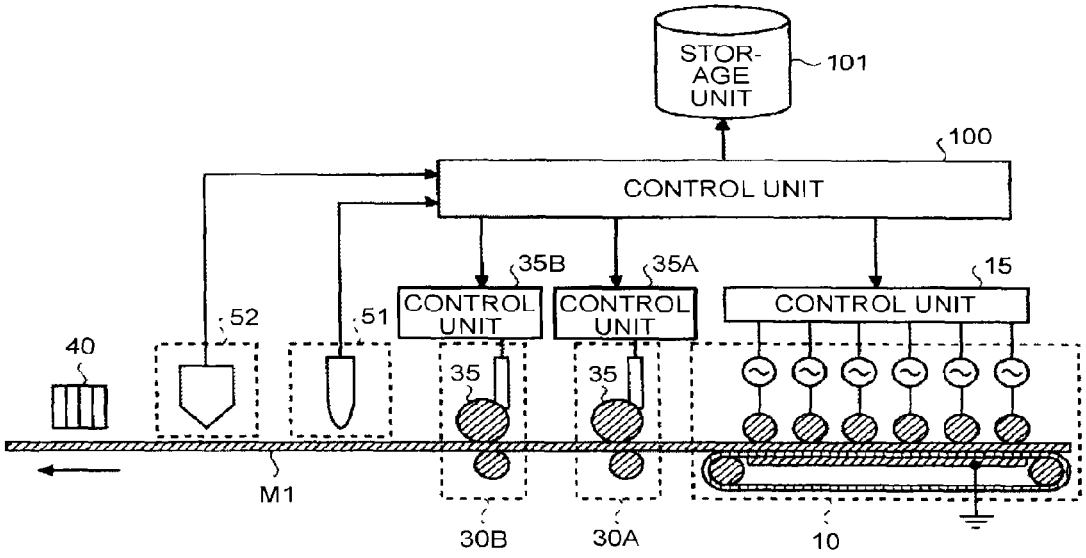
FIG. 7 is a schematic diagram illustrating the inkjet recording apparatus illustrated in FIG. 2 in a more simplified manner.

The control unit 15 may cause the dielectric 14 to revolve by driving the rollers 17 under control of a host device (not shown) (which can be a control unit 100 illustrated in FIG. 7, for example). The print medium M1 delivered by a feeding unit IN (see FIG. 14) onto the dielectric 14 is conveyed along the conveyance path R1 by the revolving motion of the dielectric 14.

The high-voltage high-frequency power supplies 12*a* to 12*f* apply high-voltage high-frequency pulse voltages respectively to the discharge electrodes 11*a* to 11*f*. The pulse voltages may be applied to all of the discharge electrodes 11*a* to 11*f*. Alternatively, the pulse voltage(s) may be applied to one or more of the discharge electrodes 11*a* to 11*f*, the number of which depends on predetermined plasma treatment (for example, plasma treatment for lowering the pH value to a predetermined value or lower) to be applied to the surface of the print medium M1. The control unit 15 may control frequency and voltage values (plasma energy density) of the pulse voltages to be respectively supplied from the high-voltage high-frequency power supplies 12*a* to 12*f* to a plasma energy density necessary to apply the predetermined plasma treatment to the surface of the print medium M1.

The control unit 15 is capable of individually switching on and off the high-voltage high-frequency power supplies 12*a* to 12*f*. For example, the control unit 15 may select the number of the high-voltage high-frequency power supplies 12*a* to 12*f* to be driven or adjust the intensity of plasma energy of the pulse voltages to be applied to the discharge electrodes 11*a* to 11*f* in proportion to information about a printing speed. Alternatively, the control unit 15 may adjust the number of the high-voltage high-frequency power supplies 12*a* to 12*f* to be driven and/or the plasma energy density of the pulse voltages to be applied to the discharge electrodes 11*a* to 11*f* according to type (e.g., "coated paper" or "polyethylene terephthalate (PET) film") of the print medium M1.

Providing the multiple discharge electrodes 11*a* to 11*f* in this manner is also advantageous in uniformly acidifying the surface of the print medium M1. More specifically, under the same condition of conveying speed (or printing speed) of the print medium M1, acidification treatment using multiple discharge electrodes allows increasing duration, over which the print medium M1 passes through plasma space, to be longer than that of acidification treatment using a single discharge electrode. Consequently, the surface of the print medium M1 can be acidified more uniformly.

Meanwhile, the plasma treatment using atmospheric-pressure non-equilibrium plasma is preferable as a method for acidifying the print medium M1. This is because electron temperature of the atmospheric-pressure non-equilibrium plasma is extremely high, whereas gas temperature is close to room temperature. To generate atmospheric-pressure non-equilibrium plasma stably over a wide range, it will be most preferable to use dielectric barrier discharge based on streamer breakdown obtained by applying alternating high voltages across electrodes coated with a dielectric. The method for generating the atmospheric-pressure non-equilibrium plasma is not limited to the dielectric barrier discharge based on streamer breakdown, and various other methods are usable. Examples of the usable method include a method of producing dielectric barrier discharge by inserting an insulator such as a dielectric between electrodes, a method of producing corona discharge by forming a highly-non-uniform electric field around a thin metal wire or the like, and a method of producing pulse discharge by applying a short pulse voltage. A combination of two or more of these methods is also usable.

Figure 4:
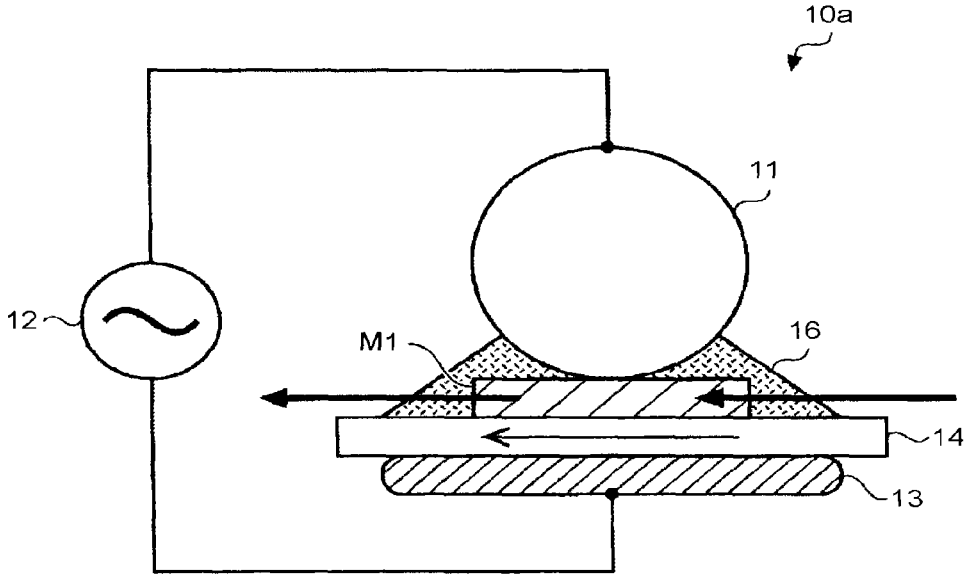
FIG. 4 is a schematic diagram illustrating an example of an atmospheric-pressure non-equilibrium plasma treatment unit applicable to the acidification unit illustrated in FIG. 2.

FIG. 4 is a schematic illustrating an example of an atmospheric-pressure non-equilibrium plasma treatment unit 10*a* applicable to the acidification unit 10 illustrated in FIG. 2. Referring to FIG. 4, a plasma treatment unit 10*a* includes the discharge electrodes 11, the ground electrode 13, the dielectric 14, and the high-voltage high-frequency power supplies 12. The dielectric 14 is interposed between the discharge electrodes 11 and the ground electrode 13. Each of the discharge electrodes 11 and the ground electrode 13 may be an electrode including a bare metal portion, or may be an electrode covered with a dielectric or an electrical insulator such as electrical-insulation rubber or a ceramic. The dielectric 14 interposed between the discharge electrodes 11 and the ground electrode 13 may be an insulator such as a polyimide, silicone, or a ceramic. If corona discharge is employed as the plasma treatment, the dielectric 14 may be omitted. However, even when corona discharge is employed, it will be preferable to include (not to omit) the dielectric 14 in some configurations including a configuration which employs dielectric barrier discharge, for example. In that case where the dielectric 14 is included, the dielectric 14 is preferably located at a position near or in contact with the ground electrode 13 rather than at a position where the dielectric 14 is near or in contact with the discharge electrodes 11 so that a surface discharge area is widened and effect of the plasma treatment can be enhanced. The discharge electrodes 11 and the ground electrode 13 (or, in a configuration where the dielectric 14 is included, the dielectric 14) (hereinafter, sometimes referred to as the "electrode pair") may be arranged at positions where the electrode pair is brought into contact with the print medium M1 passing through between the electrode pair or at positions where the electrode pair is not brought into contact with the same.

The high-voltage high-frequency power supplies 12 apply high-voltage high-frequency pulse voltages across the discharge electrodes 11 and the ground electrode 13. The voltage value of the pulse voltage may be approximately 10 kilovolts (kV) (peak-to-peak voltage), for example. The frequency of the pulse voltage may be approximately 20 kilohertz (kHz), for example. Applying such high-voltage high-frequency pulse voltages across the electrode pair generates atmospheric-pressure non-equilibrium plasma 16 between the discharge electrodes 11 and the dielectric 14. The print medium M1 passes through between the discharge electrodes 11 and the dielectric 14 during when the atmospheric-pressure non-equilibrium plasma 16 is generated. As a result, the surface of the print medium M1 on the side of the discharge electrodes 11 side undergoes the plasma treatment.

The plasma treatment unit 10*a* illustrated in FIG. 4 employs the rotary discharge electrodes 11 and the belt-conveyor type dielectric 14. The print medium M1 is nipped and conveyed by the rotating discharge electrodes 11 and the dielectric 14 so as to pass through the atmospheric-pressure non-equilibrium plasma 16. The surface of the print medium M1 is brought into contact with the atmospheric-pressure non-equilibrium plasma 16 in this way. Consequently, the surface is plasma-treated uniformly. However, the configuration of the plasma treatment device which can be employed in the embodiment is not limited to that illustrated in FIG. 4. The plasma treatment device may be modified in various manners. Example modifications include a configuration in which the discharge electrodes 11 are brought to vicinity of the print medium M1 rather than into contact therewith and a configuration in which the discharge electrodes 11 are mounted on the same carriage as an inkjet head. The dielectric 14 is not limited to the belt-conveyor type; a flat-plate dielectric can be employed as the dielectric 14.

The energy (hereinafter, sometimes referred to as "plasma energy density") to be applied by the acidification unit 10 (see FIG. 4) in the plasma treatment can be calculated from an electric current passing from the discharge electrodes 11 to the ground electrode 13 with the print medium M1 serving as a resistor placed therebetween, an applied voltage, and pulse duration, for example. The acidification unit 10 illustrated in FIG. 4 includes the six discharge electrodes denoted by 11*a* to 11*f*. With this configuration, energy to be consumed by the six discharge electrodes 11*a* to 11*f* in its entirety is controlled for each cycle of the plasma treatment. The control unit 15 is capable of individually switching on and off the high-voltage high-frequency power supplies 12*a* to 12*f*. The control unit 15 selects the number of the high-voltage high-frequency power supplies 12*a* to 12*f* to be driven in proportion to information about a printing speed. Necessary plasma energy density may vary with the type of the print medium M1. Also in such a case, the control unit 15 cause one or more of the discharge electrodes 11, the number of which depends on the type of the print medium M1, to generate plasma. The print medium M1 is caused to pass through between the discharge electrodes 11 and the dielectric 14 during when the atmospheric-pressure non-equilibrium plasma 16 is generated, to thus be plasma-treated. The plasma treatment breaks chains holding polymers in a binder resin on the surface of the print medium M1. The polymers recombine with oxygen radicals and ozone in the gas to form polar functional groups, whereby hydrophilicity and acidity are imparted to the surface of the print medium M1. Although the plasma treatment is applied in the air atmosphere, alternatively, the plasma treatment may be applied in a nitrogen gas atmosphere or the like.

Figure 5:
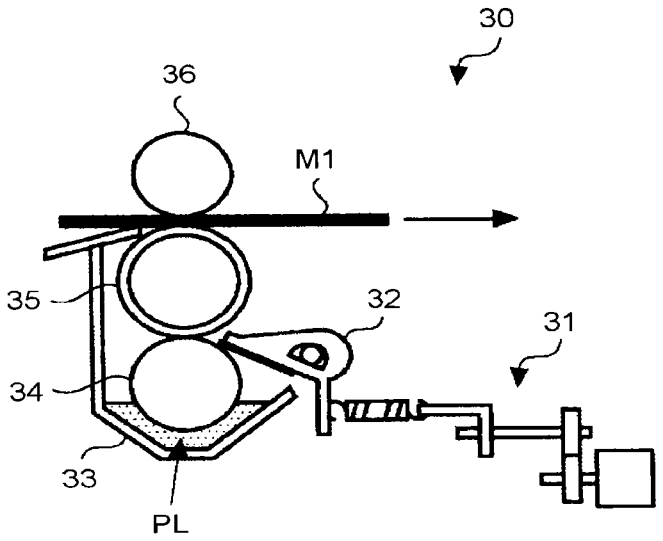
FIG. 5 is a diagram illustrating a schematic configuration of a primer applying unit illustrated in FIG. 2.
Figure 6:
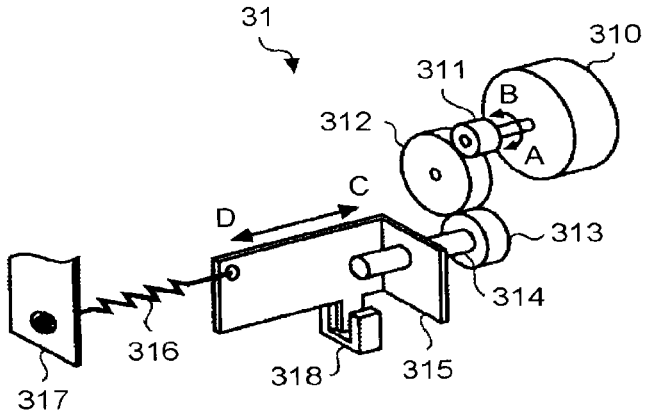
FIG. 6 is a perspective view illustrating a pressurizing mechanism illustrated in FIG. 5.

FIG. 5 is a diagram illustrating a schematic configuration of the primer applying unit (30A, 30B) illustrated in FIG. 2. FIG. 5 is a cross-sectional side view of the primer applying unit 30A or 30B (hereinafter, the "primer applying unit 30"). FIG. 6 is a perspective view illustrating a pressurizing mechanism 31 of the primer applying unit 30.

Referring to FIG. 5, the primer applying unit 30 includes two rollers, denoted by 35 and 36, configured to pinch and convey the print medium M1 therebetween, a lift roller 34 configured to transfer treatment liquid PL to the roller 35 so that the treatment liquid PL is applied onto the print medium M1, a tank 33 configured to store the treatment liquid PL in such a manner that the lift roller 34 is partially immersed in the treatment liquid PL, and the pressurizing mechanism 31 configured to control the amount of the treatment liquid PL to be transferred to the roller 35.

Fine grooves are cut in the surface of the lift roller 34. The treatment liquid carried up by the lift roller 34 is transferred onto the roller 35. The primer treatment liquid LP contains a solvent, which is water-based and has an acidic pH, and polymer materials generally referred to as cationic polymers. The cationic polymers include amines and hydrin-based polymers (epichlorohydrin polymers).

In the embodiment, the plasma treatment is applied prior to the primer treatment. The reason therefor is as follows. In a case where the print medium M1 is a low-permeable medium, the plasma treatment applied earlier increases the hydrophilicity of the surface of the medium M1, thereby allowing light and uniform application of the treatment liquid in the primer treatment.

FIG. 6 is a perspective view illustrating the pressurizing mechanism 31 illustrated in FIG. 5. Referring to FIG. 6, the pressurizing mechanism 31 includes a stepper motor 310 controlled by a control unit (not shown). A driving force of the stepper motor 310 rotating forward (direction A indicated by the double-headed arc-like arrow in FIG. 6) is transmitted to a gear 313 via a gear 311, which is arranged on a drive shaft of the stepper motor 310, and an idler gear 312.

A shaft 314, the leading end of which is formed as a feed screw, is coupled to the gear 313. Accordingly, the shaft 314 can pull an anchor 315 in a horizontal direction (direction C indicated the double-headed arrow in FIG. 6). One end of a spring 316 is attached to the anchor 315. The other end of the spring 316 is attached to a bracket 317 supporting a metering blade 32. Accordingly, a pressing force exerted by the metering blade 32 varies with horizontal movement of the anchor 315.

On the other hand, when the stepper motor 310 rotates backward (direction B indicated by the double-headed arc-like arrow in FIG. 6), the anchor 315 is pushed back in a horizontal direction (direction D indicated by the double-headed arrow in FIG. 6). As a result, the bracket 317 is pivoted in a pressure-decreasing direction, and the pressing force exerted by the metering blade 32 is reduced or eliminated.

A sensor for detecting a reference position may be arranged on the anchor 315. This sensor may be embodied as a switch configured to be switched on/off by a detection piece 318 formed on a bottom portion of the anchor 315, for example. A necessary pressing force can be applied to the metering blade 32 by adjusting a travel distance of the anchor 315 in accordance with on/off state of the sensor. It is preferable to arrange the pressurizing mechanism 31 illustrated in FIG. 6 on each of longitudinal opposite sides of the metering blade 32, at positions on an end of the metering blade 32 on the side opposite from the side where the metering blade 32 is in contact with the lift roller 34.

In the embodiment, the pressing force exerted by the metering blade 32 is adjusted by controlling the pressurizing mechanism 31 configured as described above so that the application amount falls within a range from 0.02 to 0.2 $mg/cm^2$, for example. However, the method for adjusting the application amount is not limited thereto. For example, the amount of the treatment liquid to be transferred from the lift roller 34 to the roller 35 can be adjusted by controlling the pressing force exerted from the pressurizing mechanism 31 to the metering blade 32. In this case, one of the primer applying units 30A and 30B, and the conveyance path therefor may be omitted.

A combination of the primer applying units 30A and 30B which differ from each other in the application amount may be implemented by causing the depth of the fine grooves cut in the lift roller 34 to differ between the primer applying units 30A and 30B. In this case, it is preferable that the total application amount by the primer applying units 30A and 30B is adjustable within the range from 0.02 to 0.2 $mg/cm^2$.

The inkjet recording unit 40 illustrated in FIG. 2 includes the inkjet head to record an image by ejecting ink onto the pre-treated print medium M1 under control of a control unit (not shown). The inkjet recording unit 40 may include multiple heads for a same color (in the example illustrated in FIG. 2, four heads for each of four colors). This configuration allows increasing speed of inkjet recording. To obtain a high resolution (e.g., 1,200 dots per inch (dpi)) at a high speed, the heads of each color are held in an arrangement where nozzles, from which ink is to be ejected, are in a staggered arrangement so as to reduce gaps between the nozzles. Furthermore, the control unit feeds control signals each indicating a drive frequency corresponding to one of three droplet volumes of ink to be ejected from a nozzle, to the inkjet heads. The droplet volumes may be referred to as a large droplet, a medium droplet, and a small droplet.

Figure 8:
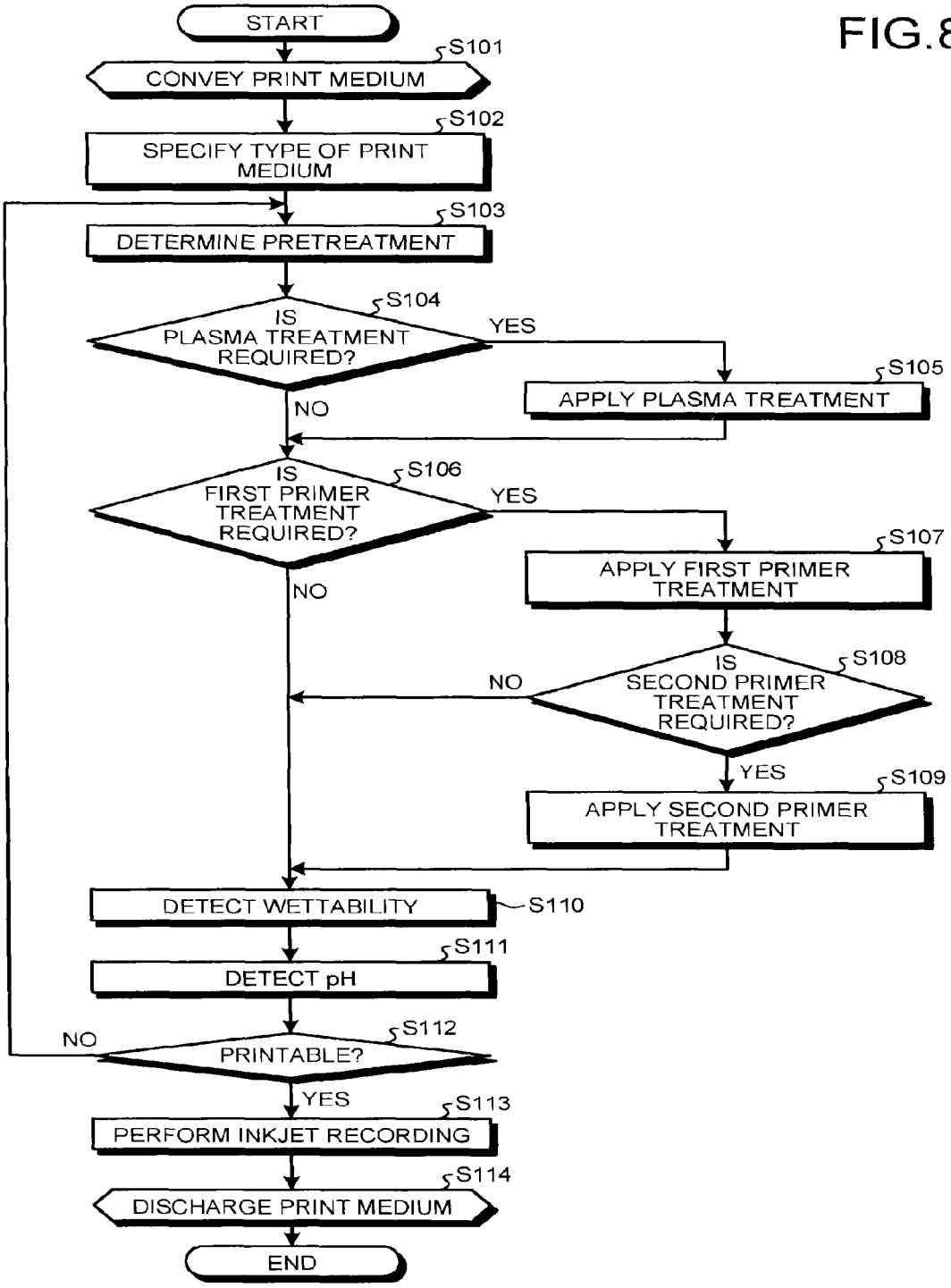
FIG. 8 is a flowchart illustrating a procedure of inkjet recording according to the embodiment.

Operation of inkjet recording, pretreatment for which can be applied by a combination of the plasma treatment and the primer treatment according to the type of a print medium, is described in detail below with reference to FIGS. 7 and 8. FIG. 7 is a schematic diagram illustrating the inkjet recording apparatus 1 illustrated in FIG. 2 in a more simplified manner. FIG. 8 is a flowchart illustrating a procedure of inkjet recording according to the embodiment. FIG. 8 illustrates a sequence executed by the control unit 100 which provides overall control of the inkjet recording apparatus 1.

Referring to FIG. 7, the inkjet recording apparatus 1 includes, in addition to the elements illustrated in FIG. 2, a control unit 35A configured to control the first primer applying unit 30A, a control unit 35B configured to control the second primer applying unit 30B, a wettability detecting unit 51 configured to detect wettability of the print medium M1, a pH detecting unit 52 configured to detect a pH value of the print medium M1, the control unit 100 configured to provide the overall control of the inkjet recording apparatus 1, and a storage unit 101 configured to store types of the print medium M1, pretreatment conditions, detection results, and the like. The wettability detecting unit 51 and the pH detecting unit 52 are arranged downstream from the acidification unit 10 and the first and second primer applying units 30A and 30B and upstream from the inkjet recording unit 40 to determine whether or not the plasma treatment and/or the primer treatment is appropriately applied as required. The control unit 100 controls a level the pretreatment to be applied to the print medium M1 by controlling the control units 15, 35A, and 35B based on detection results fed from the wettability detecting unit 51 and the pH detecting unit 52. More specifically, the control unit 100 controls the control units 15, 35A, and 35B based on the detection results fed from the wettability detecting unit 51 and the pH detecting unit 52, thereby controlling the following: whether or not to apply the plasma treatment, whether or not to apply the primer treatment, the plasma energy density (or the voltage value or the like) of the plasma treatment, the number of cycles of the primer treatment, the treatment-liquid application amount for each cycle of the primer treatment, and the like. The inkjet recording unit 40 may be controlled by a separate control unit (not shown) or may be controlled by the control unit 100.

How the inkjet recording is performed is described below. As illustrated in FIG. 8, the control unit 100 starts conveying the print medium M1 according to a command input from an input unit (not shown) (Step S101). The print medium M1 is thus delivered onto the conveyance path R1. The control unit 100 then specifies the type of the print medium M1 based on print conditions configured in advance according to an input from the input unit (Step S102), and determines pretreatment and pretreatment conditions based on a print mode (color/monochrome printing, resolution, and the like), type of the ink to be used, and the like (Step S103). Print conditions including the type of the print medium M1, the print mode, and the type of the ink to be used may be stored in the storage unit 101, for example. Association data between the print conditions and the pretreatment may be stored in the storage unit 101, for example. In Step S103, combination of the plasma treatment, first primer treatment, and second primer treatment to be applied as the pretreatment, pretreatment conditions (plasma energy density, treatment-liquid application amount, and the like) for each of the plasma treatment and the first and second primer treatments, and the like are determined.

The print medium M1 delivered onto the conveyance path R1 passes through the acidification unit 10 first. At this point, the control unit 100 determines whether or not it is determined in Step S103 that the plasma treatment is to be applied (Step S104). If it is determined in Step S103 that the plasma treatment is to be applied (YES in Step S104), the control unit 100 drives the acidification unit 10 according to the pretreatment conditions (the plasma energy density and the like) determined in Step S103, thereby applying the plasma treatment to the print medium M1 (Step S105). More specifically, the control unit 100 adjusts the number of the discharge electrodes 11*a* to 11*f* to be driven and/or the plasma energy density of the pulse voltages to be supplied by the high-voltage high-frequency power supplies 12*a* to 12*f* to the discharge electrodes 11*a* to 11*f* according to the pretreatment conditions determined in Step S103, for example. The plasma energy density can be calculated as described above from the value of the electric current passing through the print medium M1. If it is determined that the plasma treatment is not to be applied (NO in Step S104), the control unit 100 causes processing to proceed to Step S106, skipping Step S105.

The control unit 100 then determines whether or not it is determined in Step S103 that the first primer treatment is to be applied (Step S106). If it is determined that the first primer treatment is not to be applied (NO in Step S106), the control unit 100 controls the conveyance switch unit 21 so as to deliver the print medium M1 to the conveyance path R2 of the first route and causes processing to proceed to Step S110.

If it is determined that the first primer treatment is to be applied (YES in Step S106), the control unit 100 controls the conveyance switch unit 21 so as to deliver the print medium M1 to the conveyance path R11 to cause the print medium M1 to pass through the first primer applying unit 30A. The control unit 100 drives the first primer applying unit 30A according to the pretreatment conditions (the treatment-liquid application amount and the like) determined in Step S103 when the print medium M1 passes through the first primer applying unit 30A, thereby applying the first primer treatment to the print medium M1 (Step S107).

The control unit 100 determines whether or not it is determined in Step S103 that the second primer treatment is to be applied (Step S108). If it is determined that the second primer treatment is not to be applied (NO in Step S108), the control unit 100 controls the conveyance switch unit 22 so as to deliver the print medium M1 to the conveyance path R12 of the second route and causes processing to proceed to Step S110.

If it is determined that the second primer treatment is to be applied (YES in Step S108), the control unit 100 controls the conveyance switch unit 22 so as to deliver the print medium M1 to the conveyance path R21, thereby causing the print medium M1 to pass through the second primer applying unit 30B. The control unit 100 drives the second primer applying unit 30B according to the pretreatment conditions (the treatment-liquid application amount and the like) determined in Step S103 when the print medium M1 passes through the second primer applying unit 30B, thereby applying the second primer treatment to the print medium M1 (Step S109), and thereafter causes processing to proceed to Step S110.

In Step S110, the control unit 100 obtains wettability of the print medium M1 from a detection result output from the wettability detecting unit 51. A method for detecting the wettability will be described later. For example, the wettability may be detected by ejecting a liquid droplet onto the print medium M1 having undergone pretreatment and measuring a dot size and shape of the droplet. The control unit 100 obtains a pH value of the print medium M1 from a detection result output from the pH detecting unit 52 (Step S111). A method for detecting the pH value will be described later. For example, the pH value of the print medium M1 having undergone pretreatment may be detected using a noncontact pH sensor. The wettability and the pH value detected in Steps S110 and S111 may be stored in the storage unit 101, for example. When being stored, the detected wettability and the pH value may be stored as being associated with the type of the print medium M1 specified in Step S102, the pretreatment conditions determined in Step S103, and the like.

Subsequently, the control unit 100 determines whether or not the wettability and the pH value detected in Steps S110 and S111 fall within a "printable" range (Step S112). If the print medium M1 is not determined to be printable (NO in Step S112), the control unit 100 brings processing back to Step S103 to apply pretreatment again. If the print medium M1 is determined to be printable (YES in Step S112), the control unit 100 causes processing to proceed to Step S113.

The print medium M1 delivered to one of the first route, the second route, and the third route is thereafter conveyed through the conveyance path R32, which are common among the routes. The control unit 100 drives the inkjet recording unit 40 in a manner timed to passage of the print medium M1 through the conveyance path R32, thereby performing inkjet recording on the print medium M1 having undergone the pretreatment (Step S113). Thereafter, the control unit 100 performs post-processing on the printed print medium M1 as required and discharges the print medium M1 (Step S114). Then, the operation ends.

In the operation illustrated in FIG. 8, the route of the print medium M1, the plasma energy density (discharge voltage and frequency) of the acidification unit 10, and the treatment-liquid application amounts of the first and second primer applying units 30A and 30B are automatically determined by the control unit 100 according to the print conditions and the like, but not limited thereto. Alternatively, for example, the route of the print medium M1, the plasma energy density (discharge voltage and frequency) of the acidification unit 10, and the application amounts of the treatment liquid of the first and second primer applying units 30A and 30B may be manually set or adjusted by a user. In this case, the control unit 100 may control the units according to user-set (user-adjusted) values.

Basically, the plasma energy density of the plasma treatment is preferably within a range of 0.1 J/cm$^2$ to 10.0 J/cm$^2$. Basically, the application amount of each of the first and second primer treatments is preferably within a range of 0.02 mg/cm$^2$ to 0.2 mg/cm$^2$. Optimum conditions of the plasma energy density and the amounts of the primer to be applied (hereinafter, sometimes referred to as "primer application amount") can be obtained by the following method, for example. Print media of various types are pre-treated with continuously-varying plasma energy density and primer application amount. Images (dots) are actually formed by inkjet recording on the pre-treated print media. The optimum conditions can be determined by measuring the printed images (dots). Evaluation measures for the images (dots) can include print density, dot diameter, circularity, and granularity in addition to visual appearance. Other evaluation measure, such as a degree of fixation, may be measured. Because these measures are affected by ink and ink recording settings, it is preferable to measure a pH value and wettability (more specifically, a contact angle between the print medium and a purified water droplet) of each of the pre-treated print media as supplemental basic properties. The inkjet recording unit 40 may preferably be controlled according to the optimum conditions determined for each of the print media based on these results.

TABLE 1 below indicates results of measurements of contact angles and pH values of sheets of low-permeable paper used as the print medium M1, onto which the plasma treatment, the primer treatment, and the combination of the plasma treatment and the primer treatment are respectively applied. Each of the contact angles presented in TABLE 1 indicates wettability and is obtained by measuring a contact angle of a deionized water droplet deposited on the print medium M1. Each of the pH values indicates acidity measured with a chemical indicator applied onto the surface of the medium. Meanwhile, each of the plasma treatment and the primer treatment acts to acidify the surface of the medium. The acidified print medium M1 neutralizes the alkaline ink, causing pigments in the ink to coagulate and the viscosity of the ink to increase. As a result, even when coalescence of dots should occur, the pigments are less likely to migrate.

TABLE 1

| Treatment | Plasma Energy Density ($J/cm^2$) | Application Amount ($mg/cm^2$) | Contact Angle θ (deg.) | pH |
|---|---|---|---|---|
| None | — | — | 71 | 6.4 |
| Plasma | 0.14 | — | 26 | 6.2 |
| Treatment | 2.78 | — | 23 | 4.8 |
| Primer | — | 0.06 | 62 | 5.8 |
| Application | — | 0.10 | 57 | 5.6 |
| Combination | 0.14 | 0.05 | 37 | 5.6 |
| | 0.14 | 0.06 | 40 | 5.6 |
| | 0.14 | 0.11 | 37 | 5.6 |

Referring to TABLE 1, when none of the plasma treatment and the primer treatment is applied, the contact angle is large. This large contact angle indicates that coated paper, which is the print medium, is repelling deionized water. In contrast, the smaller contact angle of the plasma-treated coated paper indicates that wettability is improved by the plasma treatment. Furthermore, the plasma treatment acidifies the pH of the coated paper. This is presumably because polar functional groups generated by the plasma treatment on the surface of the coated paper acidify the coated paper. Furthermore, coating layer of the coated paper is broken and pores are formed by discharge; as a result, hydrophilicity is imparted to the surface of the coated paper. Although not presented in TABLE 1, the pH value changed little when the plasma energy density was increased to approximately 2.8 $J/cm^2$ or higher. The coated paper, to which the pretreatment was applied, presented in TABLE 1 exhibited favorable property. However, the same treatment undesirably enhanced wettability or permeability excessively when applied to some types of ordinary paper and coarse paper which are more porous.

Referring to TABLE 1, although the primer treatment lowers pH to acid pH, the primer treatment does not change the contact angles so greatly as the plasma treatment does. Because it is difficult to apply the water-based primer lightly and uniformly to the hydrophilic coated paper, a certain amount of the primer is necessary to apply the primer lightly and uniformly.

Referring to TABLE 1, the combination of the plasma treatment and the primer treatment yields improvement in wettability and moderate acidification or, in short, results between those of the plasma treatment and those of the primer treatment. Meanwhile, the plasma treatment not only acidifies the surface of coated paper but also roughens the surface. Accordingly, the plasma treatment also yields an effect of making the surface more primer-wettable, thereby allowing light and uniform application of the primer.

It has thus been indicated that the combination of the plasma treatment and the primer treatment is considerably effective for both of print media for which the plasma treatment is effective and print media for which the primer treatment is effective.

Figure 9A:
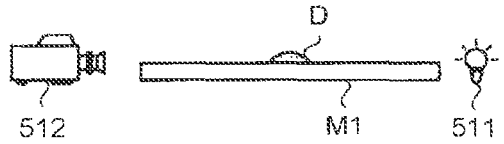
FIGS. 9(*a*), 9(*b*), and 9(*c*) are schematic diagrams illustrating an example of a wettability detection method performed by a wettability detecting unit illustrated in FIG. 7.
Figure 9B:
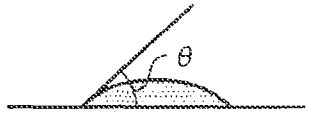
Figure 9C:
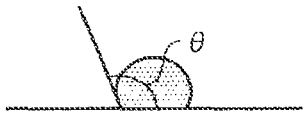
Figure 10:
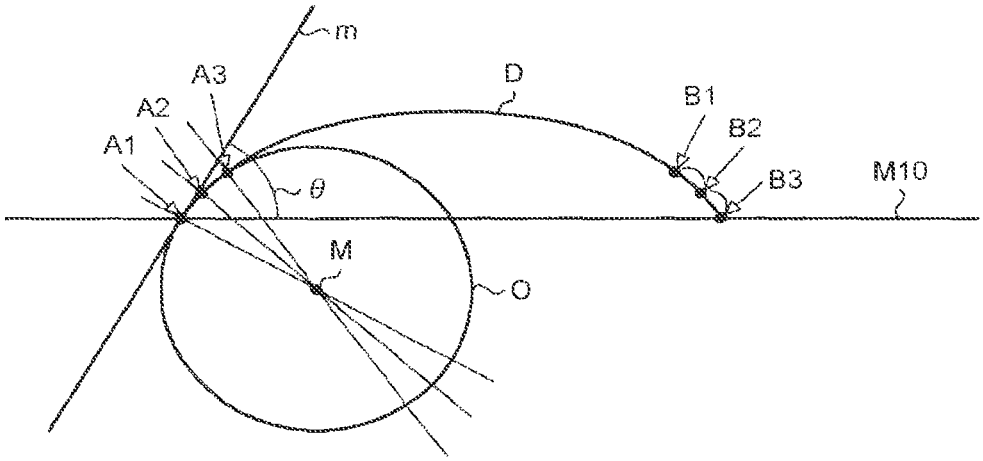
FIG. 10 is a diagram for describing a contact-angle calculation method involved in the wettability detection method illustrated in FIGS. 9(*a*) to 9(*c*)

Methods for detecting the wettability and the pH value of the print medium M1 are described below. FIGS. 9A to 9C are schematic diagrams illustrating an example of wettability detection method performed by the wettability detecting unit 51 illustrated in FIG. 7. FIG. 10 is a diagram for describing a contact-angle calculation method involved in the wettability detection method illustrated in FIGS. 9(*a*) to 9(*c*).

As illustrated in FIGS. 9(*a*) to 9(*c*), a dot D is formed by actually ejecting a liquid droplet onto the pre-treated print medium M1. The wettability detecting unit 51 performs imaging of the dot D from a lateral direction (which is a direction flush with and parallel to a printed surface of the print medium M1) using a light source 511 and a camera 512, and determines a shape of the dot D from the obtained image. The obtained image of the dot D may be transmitted to the control unit 100, for example. The control unit 100 determines a contact angle θ by analyzing the received image of the dot D, and obtains the wettability of the print medium M1 from the determined contact angle θ.

More specifically, as illustrated in FIG. 10, the control unit 100 assumes a portion near an endpoint where the dot D contacts the surface of the print medium M1 as a part of an imaginary circle (or sphere) O. Center M of the circle O is determined from three points, denoted by A1, A2, and A3, on a circular arc of the dot D. A tangent line m at the point A1 is obtained. The contact angle θ on the left side of the dot D is obtained as an angle between the tangent line m and a surface M10 of the print medium M1. Similarly, the contact angle θ on the right side of the dot D can be obtained from points B1, B2, and B3 on a circular arc of the dot D.

Figure 11:
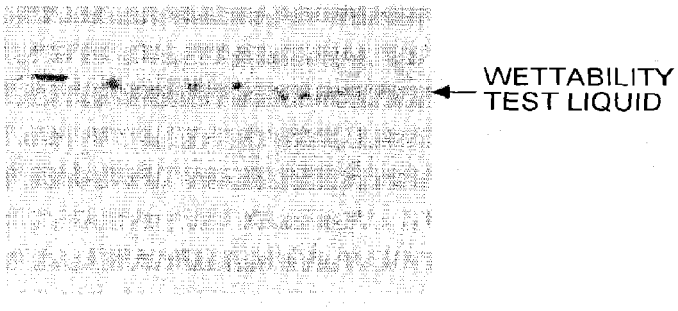
FIG. 11 is a diagram illustrating an example of an image obtained by imaging a print medium, which is poor in wettability and to which wettability test liquid is applied.
Figure 12:
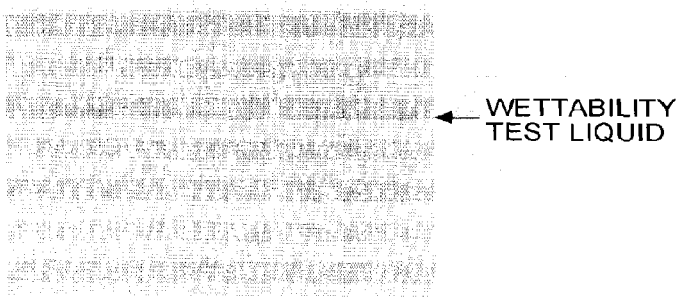
FIG. 12 is a diagram illustrating an example of an image obtained by imaging a print medium, which is favorable in wettability and to which the wettability test liquid is applied.

Various methods other than the above-described method are usable as the wettability detection method. Examples of the usable method include a method of applying a wettability test liquid onto the print medium M1, obtaining an image indicating how the print medium M1 is wet with a camera, and determining wettability based on the obtained image. FIG. 11 illustrates an example of an image obtained by imaging a print medium, which is poor in wettability and onto which the wettability test liquid is applied. FIG. 12 illustrates an example of an image obtained by imaging a print medium, which is favorable in wettability and onto which the wettability test liquid is applied. As will be apparent from comparison between FIGS. 11 and 12, the wettability test liquid is repelled from the print medium (FIG. 11) having poor wettability, whereas the wettability test liquid spreads over the print medium (FIG. 12) having favorable wettability. Wettability of a print medium can be determined from such an extent of spread of wettability test liquid.

As described above, a pH sensor with a noncontact probe can be used as the pH detecting unit 52.

Figure 13:
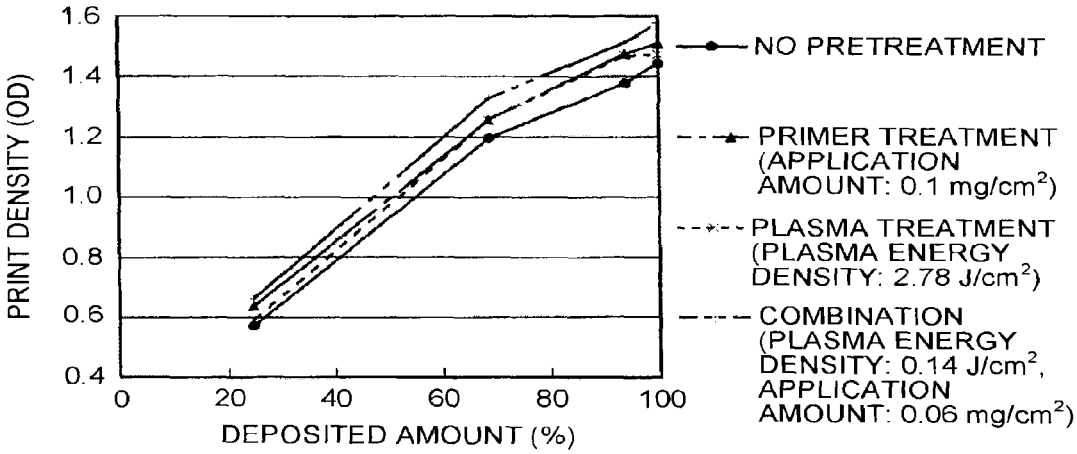
FIG. 13 is a graph illustrating relationship between print density (single color) and amount of ink deposited on print media to which different pretreatments are applied.

FIG. 13 is a graph illustrating relationship between print density (single color) and amount of ink deposited on print media to which different pretreatments are applied. In FIG. 13, the solid line indicates a result of no pretreatment. The long dashed short dashed line indicates a result of the primer treatment with an application amount of 0.1 $mg/cm^2$. The dashed line indicates a result of the plasma treatment with a plasma energy density of 2.78 $J/cm^2$. The long dashed double-short dashed line indicates a result of the combination of the plasma treatment with a plasma energy density of 0.14 $J/cm^2$ and the primer treatment with an application amount of 0.06 $mg/cm^2$. FIG. 13 presents results obtained using water-based pigment ink (i.e., ink in which pigments are dispersed in alkaline solution) having a property that the pigments in the ink coagulate in acid. The results illustrated in FIG. 13 are obtained using coated paper, which is a low-permeable medium, as the print medium.

Referring to FIG. 13, any one of the results of the pretreatments yields a higher print density than the result of no pretreatment (solid line). The result of only the primer treatment and the result of only the plasma treatment are substantially identical in print density. However, when comparison is made between actually-printed images, an image obtained with the primer treatment contains more image portions (dots) where two colors are overlaid and is also inferior in dot sharpness to an image obtained with the plasma treatment. In contrast, the image obtained with the plasma treatment has no color-mixture and exhibits favorable dot sharpness. An image obtained with the combination treatment yields highest print density among the four series presented in FIG. 13. The image obtained with only the plasma treatment is highest in granularity of dots.

The inkjet recording apparatus 1 and a method for producing a printed matter are described in detail below with reference to the drawings. In the description below, ejection heads (recording heads or ink heads) for four colors of black (K), cyan (C), magenta (M), and yellow (Y) are used as the inkjet head of the inkjet recording unit 40. However, the inkjet head of the inkjet recording apparatus 1 is not limited thereto. More specifically, the inkjet head may additionally include ejection heads for other colors such as green (G) and red (R). The inkjet head may be an ejection head only for black (K). In the description below, K, C, M, and Y represent black, cyan, magenta, and yellow, respectively.

Although a roll of continuous paper (hereinafter, "roll paper") is used as the print medium M1 in the embodiment, the print medium M1 is not limited thereto. Any print medium on which an image can be formed, such as cut paper, may be used as the print medium M1. The roll paper may be continuous paper (continuous stationary or continuous form paper) perforated transversely at regular intervals to allow tear-off at the perforation. When such continuous paper is used, a page of the roll paper corresponds to an area between adjacent perforation lines.

Example types of paper usable as the print medium include ordinary paper, woodfree paper, recycled paper, thin paper, thick paper, and coated paper. An overhead projector sheet, a synthetic resin film, a metal thin film, or other medium on which an image can be formed with ink or the like may be used as the print medium M1 as well.

Figure 14:
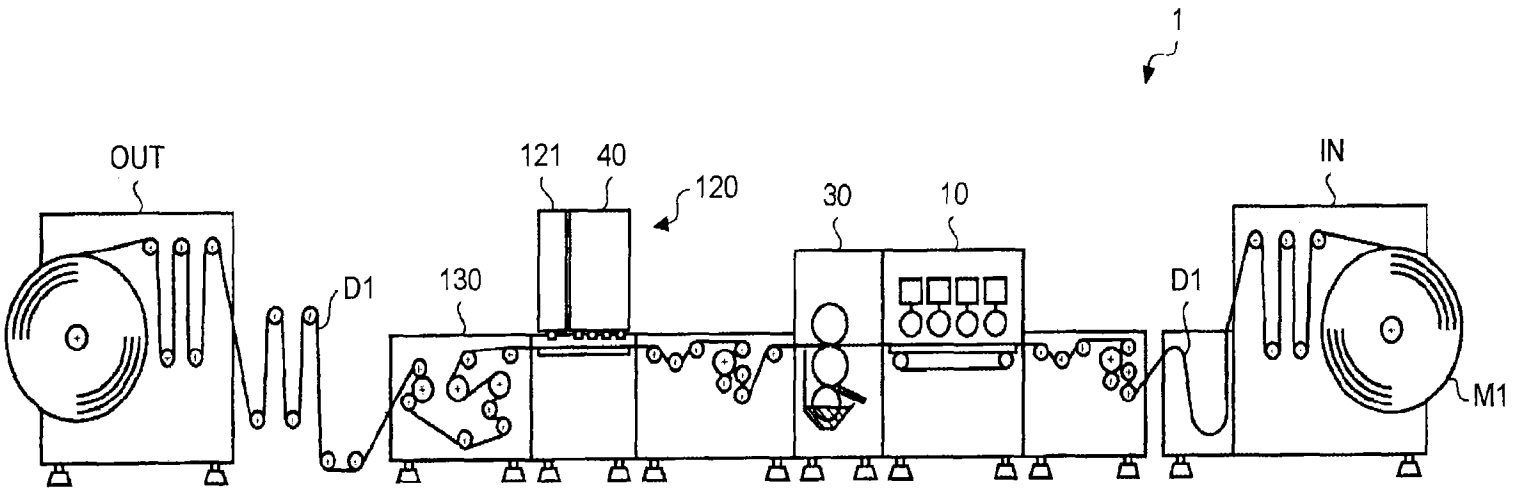
FIG. 14 is a diagram illustrating a schematic configuration of the overall inkjet recording apparatus according to the embodiment.

FIG. 14 illustrates a schematic configuration of the overall inkjet recording apparatus 1 according to the embodiment. Note that in the configuration illustrated in FIG. 14, only one of the primer treatment units 30 is depicted. Referring to FIG. 14, the inkjet recording apparatus 1 includes the feeding unit IN configured to feed (convey) the print medium M1 (roll paper) along the conveyance path D1, the acidification unit 10 configured to apply the plasma treatment as pretreatment to the fed print medium M1, the primer applying unit 30 configured to apply the primer treatment to the print medium M1 as pretreatment, and an image forming apparatus 120 configured to form an image on the surface of the print medium M1 having undergone the pretreatment. These units and apparatus may be provided in separate casings to configure a printing system. Alternatively, these units and apparatus may be provided in a single casing to serve as a printing apparatus. When configured as the printing system, a control unit which controls the whole or a part of the system may be either included in any one of the units and apparatus or provided in a separate casing.

The image forming apparatus 120 includes the inkjet recording unit 40 configured to form an image on the plasma-treated print medium M1 by inkjet recording. The image forming apparatus 120 may further include a post-processing unit 121 configured to perform post-processing on the print medium M1 on which the image is formed. The inkjet recording apparatus 1 may further include a drier unit 130 configured to dry the post-processed print medium M1 and an output unit OUT configured to convey out the print medium M1 on which the image is formed (or on which post-processing is additionally performed). The inkjet recording apparatus 1 includes the control unit 100 (see FIG. 7) configured to provide control of operations of the units.

According to the embodiment, the inkjet recording apparatus 1 illustrated in FIG. 14 performs the plasma treatment of acidifying the surface of the print medium M1 and the primer treatment of applying treatment liquid onto the print medium M1 as described above prior to inkjet recording as appropriate. As the plasma treatment, atmospheric-pressure non-equilibrium plasma treatment which utilizes dielectric barrier discharge can be used as described above. Meanwhile, the plasma treatment utilizing atmospheric-pressure non-equilibrium plasma is preferable as a plasma treatment method. This is because the electron temperature of the atmospheric-pressure non-equilibrium plasma is extremely high, whereas the gas temperature is close to room temperature.

It will be preferable to use dielectric barrier discharge based on streamer breakdown to generate atmospheric-pressure non-equilibrium plasma stably over a wide range. The dielectric barrier discharge based on the streamer breakdown can be produced by applying alternating high voltages across electrodes coated with a dielectric, for example.

The method for generating the atmospheric-pressure non-equilibrium plasma is not limited to the dielectric barrier discharge based on streamer breakdown, and various other methods are usable. Examples of the usable method include a method of producing dielectric barrier discharge by inserting an insulator such as a dielectric between electrodes, a method of producing corona discharge by forming a highly-non-uniform electric field around a thin metal wire or the like, and a method of producing pulse discharge by applying a short pulse voltage. A combination of two or more of these methods is also usable.

Figure 15:
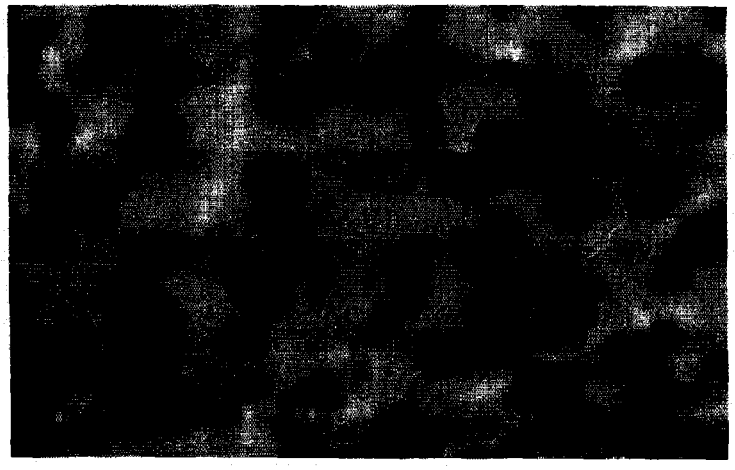
FIG. 15 is an enlarged view of an image obtained by imaging an image-formed surface of a printed matter obtained by performing inkjet recording on a print medium to which plasma treatment according to the embodiment is not applied.
Figure 16:
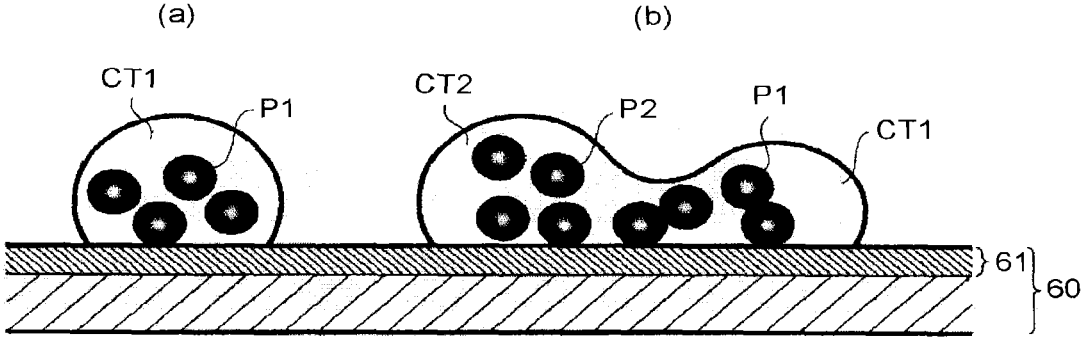
FIG. 16 is a schematic diagram illustrating an example of dots formed on the image-formed surface of the printed matter illustrated in FIG. 15.
Figure 17:
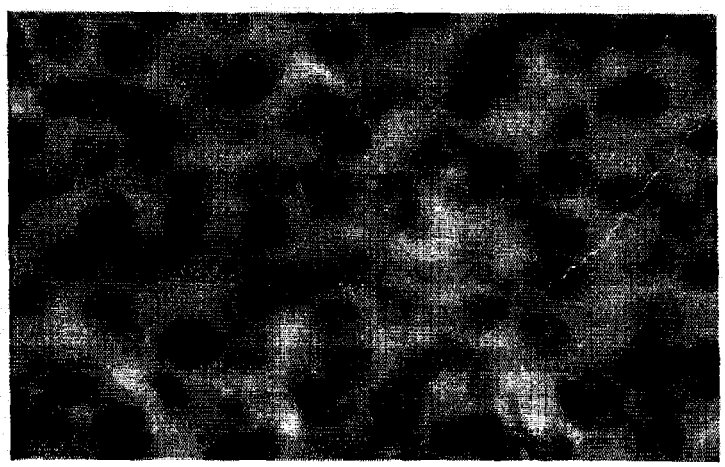
FIG. 17 is an enlarged view of an image obtained by imaging an image-formed surface of a printed matter obtained by performing inkjet recording on a print medium to which the plasma treatment according to the embodiment is applied.
Figure 18:
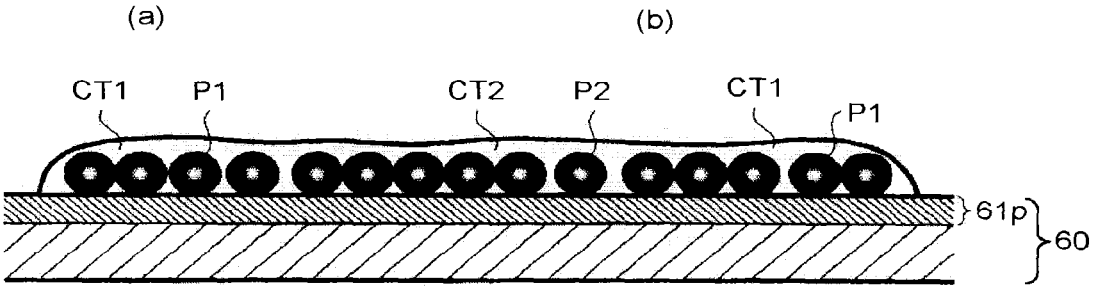
FIG. 18 is a schematic diagram illustrating an example of dots formed on the image-formed surface of the printed matter illustrated in FIG. 17.

Difference between a printed matter obtained without application of the plasma treatment according to the embodiment and a printed matter obtained with the same is described below with reference to FIGS. 15 to 18. FIG. 15 is an enlarged view of an image obtained by imaging an image-formed surface of a printed matter obtained by performing inkjet recording on a print medium to which the plasma treatment according to the embodiment is not applied. FIG. 16 is a schematic diagram illustrating an example of dots formed on the image-formed surface of the printed matter illustrated in FIG. 15. FIG. 17 is an enlarged view of an image obtained by imaging an image-formed surface of a printed matter obtained by performing inkjet recording on a print medium to which the plasma treatment according to the embodiment is applied. FIG. 18 is a schematic diagram illustrating an example of dots formed on the image-formed surface of the printed matter illustrated in FIG. 17. The printed matters illustrated in FIGS. 15 and 17 were obtained using a desktop-type inkjet recording apparatus. General coated paper 60 having a coating layer 61 was used as the print medium M1.

The coated paper 60 to which the plasma treatment according to the embodiment is not applied is poor in wettability at the coating layer 61 on the surface of the coated paper 60. Therefore, as illustrated in FIGS. 15 and 16 for example, shape (shape of a vehicle CT1) of a dot in the image formed by performing inkjet recording on the not-plasma-treated coated paper 60 is deformed when the dot is deposited on the surface (the coating layer 61) of the coated paper 60. When, before a dot becomes sufficiently dried, an adjacent dot is formed, as illustrated in FIGS. 15 and 16, the vehicle CT1 and a vehicle CT2 of the adjacent dot coagulate at deposition of the adjacent dot on the coated paper 60. As a result, migration (color mixture) of pigments P1 and pigments P2 can occur between the dots, which can undesirably result in inconsistencies in density caused by beading or the like.

In contrast, the coating layer 60*p* on the surface of the coated paper 60 to which the plasma treatment according to the embodiment is applied is improved in wettability. Accordingly, as illustrated in FIG. 17 for example, the vehicle CT1 of a dot in the image formed by inkjet recording on the plasma-treated coated paper 60 spreads in a shape close to a relatively-flat perfect circle on the surface of the coating layer 60*p* of the coated paper 60. As a result, as illustrated in FIG. 18, the dot has a flat shape. Furthermore, because polar functional groups formed by the plasma treatment acidifies the surface of the coating layer 60*p* of the coated paper 60, ink pigments are neutralized and the pigments P1 coagulate, causing viscosity of the ink to increase. As a result, even when the vehicles CT1 and CT2 coagulate as illustrated in FIG. 18, migration (color mixture) of the pigments P1 and P2 between the dots can be reduced. Moreover, because the polar functional groups are generated also inside the coating layer 60*p*, the permeability of the vehicle CT1 increases. As a result, drying in a relatively short period of time can be achieved. Because the dots, which are spread in shapes close to a perfect circle by virtue of the improved wettability, coagulate while penetrating into the coated paper, the pigments P1 coagulate uniformly in height direction. As a result, occurrence of inconsistency in density which can otherwise be caused by beading or the like can be reduced. Note that FIGS. 16 and 18 are schematic diagrams and, in practice, the pigments coagulate in a layer also on the coated paper illustrated FIG. 18.

As described above, the print medium M1 to which the plasma treatment according to the embodiment is applied is improved in wettability because hydrophilic functional groups are generated on the surface of the print medium M1 by the plasma treatment. Furthermore, because the plasma treatment increases surface roughness of the print medium M1, the wettability of the surface of the print medium M1 is further improved. Furthermore, the polar functional groups generated by the plasma treatment acidify the print medium M1. These phenomena cause deposited ink to spread uniformly on the surface of the print medium M1 and neutralize negatively-charged pigments. The neutralized pigments coagulate on the surface of the print medium M1 and increase the viscosity. As a result, even when dots coalescence should occur, migration of pigments can be reduced. Moreover, because the polar functional groups are generated also inside the coating layer formed on the surface of the print medium M1, vehicle permeates into the print medium M1 quickly, which leads to reduction in drying time. In other words, a dot which has spread in a shape close to a perfect circle by virtue of the increase in wettability permeates into the print medium M1 in a state where migration of pigments is reduced by pigment coagulation. Accordingly, the dot can retain its shape close to a perfect circle.

Figure 19:
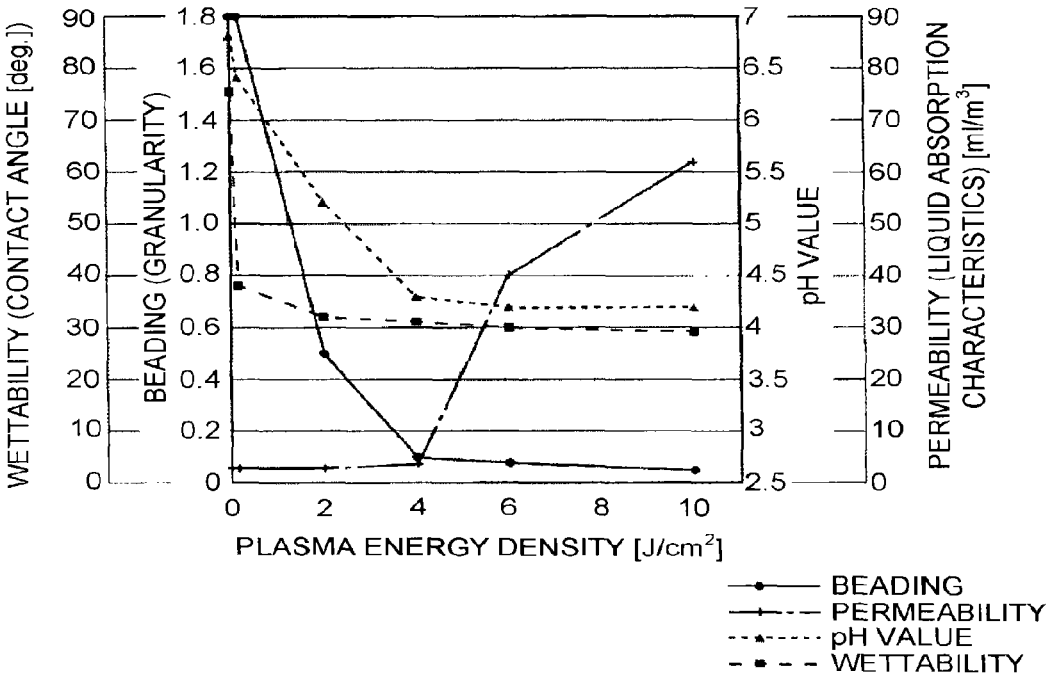
FIG. 19 is a graph illustrating relationships between plasma energy density and each of wettability, beading, pH value, and permeability of a surface of a print medium according to the embodiment.

FIG. 19 is a graph illustrating relationships between plasma energy density and each of wettability, beading, pH value, and permeability of a surface of a print medium according to the embodiment. FIG. 19 illustrates how surface properties (wettability, beading, pH value, and permeability (liquid absorption characteristics)) of coated paper, which is used as the print medium M1 and on which an image is printed, change with the plasma energy density. The evaluation result illustrated in FIG. 19 was obtained using water-based pigment ink (i.e., ink in which pigments are dispersed in alkaline solution) having a property that the pigments in the ink coagulate in acid.

As illustrated in FIG. 19, the wettability of the surface of the coated paper is improved sharply in a range where the plasma energy density is low (e.g., approximately 0.2 J/cm$^2$ or lower) but not improved greatly even when the plasma energy density is increased to be higher than the range. By contrast, as the plasma energy density increases, the pH value of the surface of the coated paper decreases to near a certain value. However, this decrease in the pH value saturates at the certain value (e.g., approximately 4 J/cm$^2$) of the plasma energy density. The permeability (liquid absorption characteristics) sharply improves from near a value corresponding to the plasma energy density (e.g., approximately 4 J/cm$^2$) at which the decrease in the pH value saturates. However, this phenomenon varies with polymers contained in the ink.

As described above, in terms of the relationship between surface properties of the print medium M1 and image quality, the dot circularity is improved as the wettability of the surface is improved. This is presumably because the surface roughness increased by the plasma treatment and the hydrophilic polar functional groups generated by the same not only improve the wettability of the surface of the print medium M1 but also make the wettability more uniform. Another possible cause may be that the plasma treatment removes water-repellent factors such as dusts, oil, and calcium carbonate from the surface of the print medium M1. More specifically, the plasma treatment improves the wettability of the surface of the print medium M1 and removes the water-repellent factors from the surface of the print medium M1. As a result, a droplet is evenly spread toward its circumference, and therefore dot circularity is improved.

Furthermore, acidifying (lowering the pH of) the surface of the print medium M1 results in coagulation of ink pigments, improvement in permeability, and penetration of vehicle to inside the coating layer. Because pigment density on the surface of the print medium M1 is increased by these phenomena, even when dot coalescence should occur, migration of pigments can be reduced. As a result, mixture of the pigments is reduced, making it possible to cause the pigments to settle and coagulate uniformly on the surface of the print medium M1. However, the effect of reducing pigment mixture depends on components of the ink and/or the volume of the ink droplet. For example, the pigment mixture is less likely to occur in a small ink droplet than in a large ink droplet. This is because, the smaller the vehicle, the faster the vehicle dries and penetrates and, accordingly, the smaller the vehicle, the smaller the necessary change in pH to cause the pigments in the vehicle to coagulate. Meanwhile, the effect yielded by the plasma treatment varies with the type of the print medium M1, the environment (humidity or the like), and the like. For this reason, the plasma energy density of the plasma treatment may be controlled to an optimum value according to the type of the print medium M1, the environment, and the like. Such control can possibly improve surface modification efficiency of the print medium M1, thereby achieving further energy saving.

Figure 20:
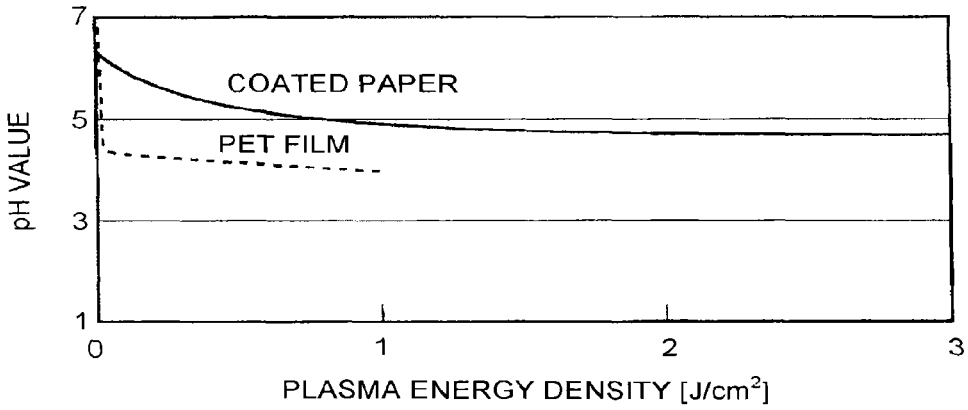
FIG. 20 is a graph illustrating relationship between plasma energy density and pH value according to the embodiment.

FIG. 20 is a graph illustrating relationship between plasma energy density and pH value according to the embodiment. Although the pH is generally measured in a solution, measuring a surface pH of a solid has become possible in recent years. As a measuring instrument for such solid surface pH measurement, a pH meter B-211 manufactured by HORIBA, Ltd. may be used.

In FIG. 20, the solid line illustrates dependency relationship between pH value of coated paper and plasma energy density; the dashed line illustrates dependency relationship between pH value of a PET film and plasma energy density. As illustrated in FIG. 20, the PET film is acidified with lower plasma energy density than the coated paper. It should be noted that the plasma energy density necessary for acidifying the coated paper is as low as 3 J/cm$^2$ or lower. Shapes of dots of an image formed by an inkjet recording apparatus by ejecting alkaline water-based pigment ink on the print medium M1, the pH value of which was lowered to 5 or lower, were close to a perfect circle. A favorable image free from mixture of pigments resulting from dot coalescence and bleeding was obtained (see FIG. 17).

Possible methods for obtaining the plasma energy density necessary to acidify the surface of the print medium M1 include increasing time over which the plasma treatment is applied (hereinafter, "plasma treatment time"). This can be achieved by, for example, decreasing the conveying speed of the print medium M1. However, the plasma treatment time is desirably reduced when high-speed recording of an image onto the print medium M1 is desired. Possible methods for reducing the plasma treatment time include the above-described method of providing the multiple discharge electrodes 11*a* to 11*f* and driving one or more of the discharge electrodes 11*a* to 11*f*, the number of which depends on the printing speed and the necessary plasma energy density, and a method of adjusting the intensity of plasma energy to be applied to each of the discharge electrodes 11*a* to 11*f*. However, the possible methods are not limited to these, and may include combinations of these methods, other methods, and appropriate modifications.

Relationship between amount of ink deposited on ordinary paper, which is used as the print medium M1 and to which the combination of the plasma treatment and the primer treatment is applied, and image density is described below with reference to FIG. 21.

Figure 21:
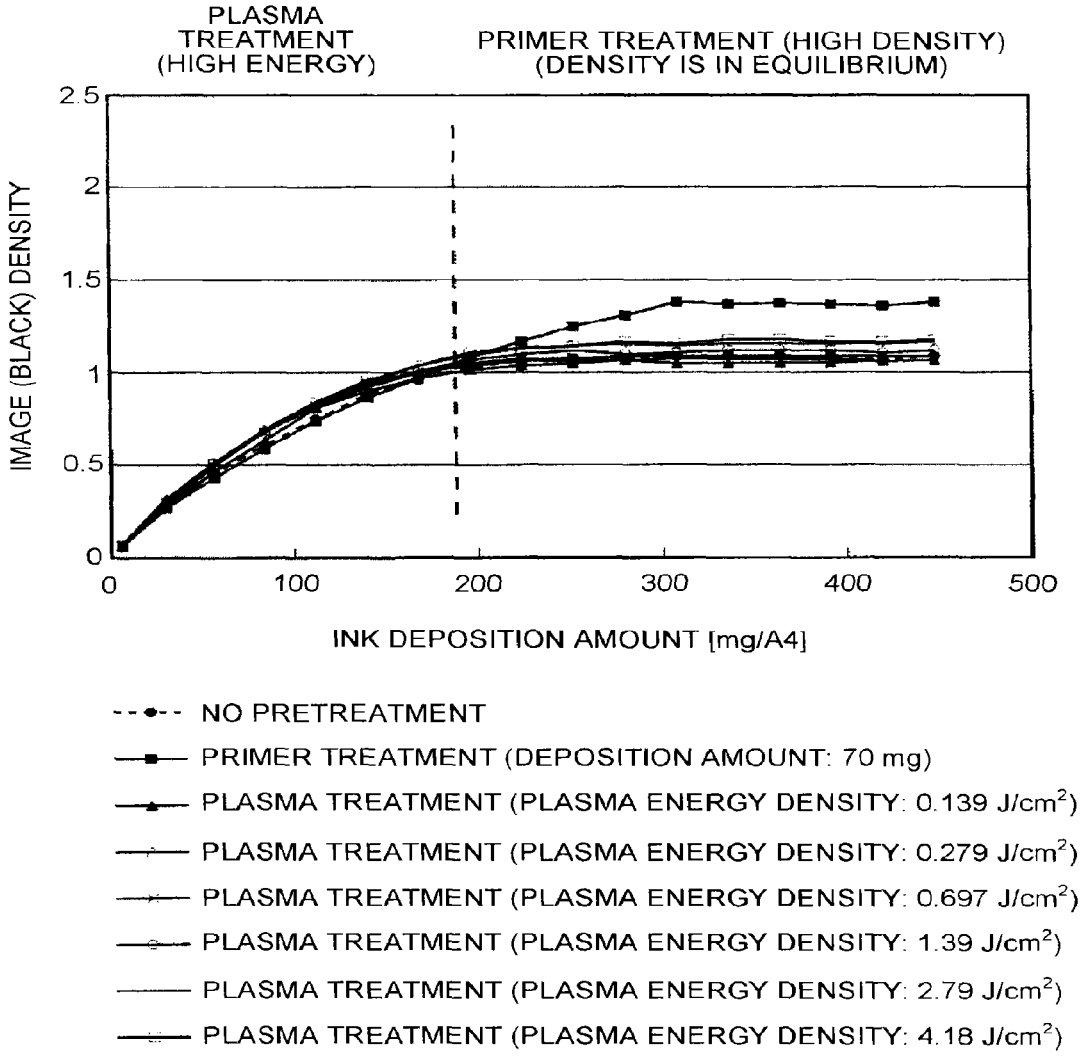
FIG. 21 is a graph illustrating relationship between image density and amount of ink deposited on ordinary paper, which is used as a print medium and to which combination of plasma treatment and primer treatment is applied.

Referring to FIG. 21, when applied to ordinary paper used as the print medium M1, the plasma treatment can be said to be superior to the primer treatment in a density range (halftone density) where dots of a printed image are not in density equilibrium (density saturated) yet. Density of dots on the plasma-treated print medium is slightly higher than density of dots on a print medium to which neither the plasma treatment nor the primer treatment is applied. It should be noted that saturation density of the dots on the plasma-treated print medium is lower than that on a primer-applied print medium. The dot density on the primer-applied print medium is increased by the effect of the primer treatment of improving fixation of ink onto the print medium.

An amount of ink to be deposited (hereinafter, "ink deposition amount") to obtain a same gray level is smaller with a plasma-treated print medium than that with a primer-treated print medium. More specifically, the plasma treatment allows reducing an amount of ink to be deposited on a halftone image by approximately 1% to 18% than that to be deposited (to obtain the same gray level) on a print medium to which no pretreatment is applied. The plasma treatment allows reducing the ink deposition amount on a halftone image by approximately 15% to 29% than the primer treatment. Meanwhile, the reason why the plasma treatment is inferior to the primer treatment in saturation density (maximum density) is presumably that application of SDF treatment to ordinary paper causes dots to spread wider. As a result, more gaps between dots are filled under the same condition of the ink deposition amount. By contrast, the reason why the primer treatment increases the saturation density is presumably that because dots on a primer-applied print medium spread less, the dots have higher dot density, whereby the saturation density is increased.

It can be said from the above that the effect of the plasma treatment and that of the primer treatment vary between a low-permeable print medium and a highly-permeable print medium. Accordingly, configuring a system to apply the combination of the plasma treatment and the primer treatment leads to improving adaptability to print media (i.e., effect of pretreatment). The combination of the plasma treatment and the primer treatment allows reducing the plasma energy density to approximately 1/20 of pretreatment of only the plasma treatment and reducing the application amount to approximately 3/5 of pretreatment of only the primer treatment. As a result, the combination allows obtaining a printed matter of a high image quality with low energy consumption and small application amount. Moreover, the high density of dots on the printed image indicates that the ink deposition amount can be reduced. Accordingly, the combination allows cost reduction by reducing the ink deposition amount. The plasma treatment is effective for a low-permeable print medium, whereas the primer treatment is effective for a highly-permeable print medium. Accordingly, optimum pretreatment can be applied by changing the combination of the plasma treatment and the primer treatment and pretreatment conditions therefor according to properties of a print medium.

Figure 22:
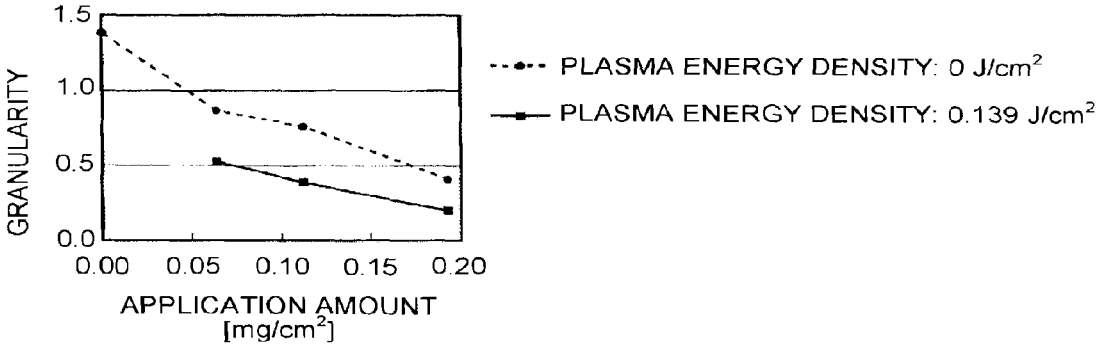
FIG. 22 is a graph illustrating granularity of a low-permeable print medium to which the combination of the plasma treatment and the primer treatment is applied.

FIG. 22 is a graph illustrating granularity of a low-permeable print medium to which the primer treatment only is applied and the combination of the plasma treatment and the primer treatment is applied. FIG. 22 indicates that the lower the granularity, the more favorable the image on the print medium is. The legend entries indicate plasma treatment energy. In FIG. 22, the series "PLASMA ENERGY DENSITY: 0 J/cm$^2$" indicates a result of the application amount of the treatment liquid applied only by the primer treatment. The series "PLASMA ENERGY DENSITY: 0.139 J/cm$^2$" indicates a result of application of the combination. Referring to FIG. 22, the necessary application amount to achieve granularity of 0.5 or lower, for example, only by the primer treatment is approximately 0.2 mg/cm$^2$. In contrast, the necessary application amount to achieve the same by the combination of the plasma treatment and the primer treatment is approximately 0.1 mg/cm$^2$, which is substantially a half of that of only the primer treatment.

The optimizing control described above depends on the properties of the print medium. A modification may be configured to perform optimizing control based on an image to be printed. This modification may be implemented as follows, for example. The inkjet recording apparatus 1 is configured to include a reflection density meter. Reference print patterns are printed by the inkjet recording unit 40 with continuously-varying plasma energy densities and application amounts of the primer. Print densities of the printed images are measured with the reflection density meter. Pretreatment conditions which yield a highest print density are defined as optimum conditions. Inkjet recording is performed so as to maintain the optimum conditions. This modification allows quick measurement and adjustment of pretreatment conditions, thereby achieving fast inkjet recording. The modification may be further modified so as to store density data output from the reflection density meter in the storage unit 101 or the like as being associated with pretreatment conditions for the print medium M1, thereby forming a database of the data.

Meanwhile, the optimum conditions also vary with a composition of ink, type of the ink, type of a print medium, or a combination thereof. Therefore, optimum inkjet recording can be implemented by storing pretreatment conditions and density information for each of these factors in the inkjet recording apparatus 1, so that a printed matter of high quality can be produced stably.

Still another possible modification may include measuring electrical resistance across the print medium M1 to roughly determine the thickness and the properties of the print medium M1 prior to the plasma treatment, optimizing the pretreatment conditions as described above based on the thickness and the properties, and performing the combination pretreatment with the optimized pretreatment conditions.

Still another possible modification may be configured such that the inkjet recording apparatus 1 further includes a sensor for checking a result of the plasma treatment downstream of the plasma treatment unit 10*a* and a sensor for checking a result of the primer treatment downstream of the primer applying unit 30 so that, when the print medium M1 is cut paper, the pretreatment can be repeated via another conveyance route as necessary. This modification may further be modified such that data obtained using the sensors is transmitted to the control unit 100, and the control unit 100 changes the pretreatment conditions accordingly.

As described above, the pretreatment by the combination of the plasma treatment and the primer treatment not only reduces energy necessary to perform the plasma treatment, which leads to reduction in the size of the plasma treatment unit 10*a*, but also reduces the application amount of the primer to be applied in the primer treatment, thereby reducing time and energy necessary for drying the treatment liquid and, furthermore, reducing ink consumption. Moreover, when an image is recorded on a print medium to which the combination of the plasma treatment and the primer treatment is applied, dots of the image have shapes close to perfect circle and, even when coalescence of the dots should occur, mixture of pigments is less likely to occur. Accordingly, a favorable image with less bleeding can be obtained.

As described above, the embodiment is configured to be capable of applying the combination of the plasma treatment and the primer treatment as pretreatment of the inkjet recording and, accordingly, can apply pretreatment which takes advantages of both the plasma treatment and the primer treatment. The advantages include, for example, reducing the plasma energy density and reducing the application amount of the primer while maintaining high quality of print image. Furthermore, compensation for disadvantage of each of the plasma treatment and the primer treatment can be made by controlling each of the treatments differently according to the type of the print medium M1. Consequently, optimum pretreatment can be applied to every type of the print medium.

Although the invention has been described with regard to certain preferred embodiments thereof, it is to be understood that the description is not meant as a limitation. Further modifications may occur to those skilled in the art, and it is intended to cover such modifications as fall within the scope of the appended claims.

Aspects of the present invention provide systems, apparatuses, and printed-matter production methods configured to be capable of optimizing pretreatment according to a type of a print medium.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A printing apparatus comprising:

a plasma treatment unit configured to apply plasma treatment to a surface of a print medium;

a primer applying unit configured to apply primer treatment that at least applies treatment liquid to the surface of the print medium haying undergone the plasma treatment; and a recording unit configured to perform inkjet recording by applying ink directly on the primer treatment which is on the print medium having undergone the plasma treatment and the primer treatment in this order, wherein the ink to be applied by the recording unit on the primer treatment contains liquid and negatively-charged pigment dispersed in the liquid.

2. The printing apparatus according to claim 1, further comprising a first controller configured to control a density of plasma energy to be applied by the plasma treatment unit to the surface of the print medium according to type of the print medium and control an application amount of the treatment liquid to be applied by primer applying unit according to the type of the print medium.

3. The printing apparatus according to claim 2, wherein the first controller is configured to determine at least one of the plasma energy density according to the type of the print medium and the application amount according to the type of the print medium based on a maximum value of a print density of an image formed by the inkjet recording.

4. The printing apparatus according to claim 2, further comprising a first sensor configured to detect at least one of wettability and a pH value of the print medium having under gone the plasma treatment and the primer treatment and output a detection result, wherein the first controller is configured to control the plasma energy density to be applied by the plasma treatment unit according to the detection result and control the application amount of the treatment liquid to be applied by the primer applying unit according to the detection result.

5. The printing apparatus according to claim 4, wherein the first sensor is configured to detect the wettability based on a contact angle between the surface of the print medium and a dot formed by the recording unit by the inkjet recording.

6. The printing apparatus according to claim 2, further comprising a memory configured to store association data between the type of the print medium, print conditions for the inkjet recording to be performed by the recording unit, and pretreatment conditions for the plasma treatment unit and the primer applying unit, wherein the first controller is configured to optimize at least one of the plasma energy density to be applied by the plasma treatment unit and the application amount of the treatment liquid to be applied by the primer applying unit based on the association data stored in the memory.

7. The printing apparatus according to claim 1, wherein the primer applying unit includes;

a first roller configured to apply the treatment tquid to the print medium, a tank configured to store the treatment liquid, a second roller configured to carry up the treatment liquid from the tank and transfer the treatment liquid to the first roller, a blade configured to regulate an amount of the treatment liquid to be carried up by the second roller, and an adjustment mechanism configured to adjust the amount of the treatment liquid to be carried up by the second roller by controlling the blade.

8. The printing apparatus according to claim 1, further comprising:

a first route configured to convey the print medium via the plasma treatment unit and the recording unit;

a second route configured to convey the print medium via the plasma treatment unit, the primer applying unit, and the recording unit; and a first route-switch unit configured to switch a conveyance route of the print medium between the first route and the second route.

9. The printing apparatus according to claim 8, further comprising a second controller configured to control the first route-switch unit so as to switch the conveyance route of the print medium to one of the first route and the second route.

10. The printing apparatus according to claim 9, wherein the second controller is configured to control the first route-switch unit so as to switch the conveyance route of the print medium to one of the first route and the second route according to type of the print medium.

11. The printing apparatus according to claim 1, wherein the plasma treatment unit applies, as the plasma treatment, corona discharge treatment to the surface of the print medium.

12. The printing apparatus according to claim 1, wherein the primer applying unit includes a drier that dries the treatment liquid on the surface of the print medium.

13. The printing apparatus according to claim 1, wherein the print medium is a film.

14. The printing apparatus according to claim 13, wherein the film is polyethylene terephthalate film.

15. The printing apparatus according to claim 1, wherein the print medium is an impermeable medium.

16. The printing apparatus according to claim 1, wherein the primer applying unit includes a roller by which the treatment liquid is applied to the surface of the print medium.

17. The printing apparatus according to claim 16, wherein the primer applying unit includes, as the roller, at least two rollers, and the treatment liquid is transferred between the at least two rollers.

18. The printing apparatus according to claim 1, wherein:

the recording unit performs the inkjet recording using water-based ink.

19. The printing apparatus according to claim 1, wherein:

the primer increase a dot density of the ink.

20. The printing apparatus according to claim 1, wherein:

the primer reduces bleeding of an image created by the recording unit, and the primer acidifies the print medium to reduce the bleeding.

21. The printing apparatus according to claim 1, wherein:

the primer improves fixation of ink onto the print medium.

22. A printing method comprising:

applying plasma treatment to a surface of a print medium;

applying treatment liquid to at least the surface of the print medium having undergone the plasma treatment; and performing inkjet recording by applying ink directly on the treatment liquid which is on the print medium having undergone the plasma treatment and the applying of the treatment liquid in this order, wherein the ink applied on the treatment liquid includes liquid and negatively-charged pigment dispersed in the liquid.

23. The printing method according to claim 22, wherein:

the performing of the inkjet recording uses water-based ink.

24. The printing method according to claim 22, wherein:

the print medium comprises a film, and the applying of the plasma treatment, the applying of the treatment liquid, and the performing of the inkjet recording are each performed on the film.

25. The printing method according to claim 22, wherein:

the treatment liquid increases a dot density of the ink.

26. The printing method according to claim 22, wherein:

the treatment liquid reduces bleeding of an image created by the recording unit, and the treatment liquid acidifies the print medium to reduce the bleeding.

27. The printing method according to claim 22, wherein:

the treatment liquid improves fixation of ink onto the print medium.

28. A printing system:

a plasma treatment unit configured to apply plasma treatment to a surface of a print medium;

a primer applying unit configured to apply primer treatment that at least applies treatment liquid to the surface of the print medium having undergone the plasma treatment; and a recording unit configured to perform inkjet recording by applying ink directly on the primer treatment which is on the print medium having undergone the plasma treatment and the primer treatment in this order, wherein the ink to be applied by the recording unit on the primer treatment contains liquid and negatively-charged pigment dispersed in the liquid.

29. A printing apparatus comprising:

a plasma generator to apply plasma to a print medium;

a roller to apply primer treatment in a form of a liquid to the print medium, after the print medium has the plasma applied thereto; and a nozzle to directly discharge ink on the primer treatment on the print medium, wherein the ink to be applied by the nozzle on the primer treatment contains liquid and negatively-charged pigment dispersed in the liquid.

30. The printing apparatus according to claim 29, wherein:

the nozzle discharges the ink which includes water-based ink.

31. The printing apparatus according to claim 29, wherein:

the print medium comprises a film.

32. The printing apparatus according to claim 29, further comprising:

another roller to apply the liquid to the print medium, after the print medium has the plasma applied thereto.

33. The printing apparatus according to claim 29, wherein:

the plasma generator includes an electrode.

34. The printing apparatus according to claim 33, wherein:

the electrode contacts the print medium when the plasma generator is generating the plasma.

35. The printing apparatus according to claim 33, wherein:

the electrode of the plasma generator generates a corona discharge.

36. The printing apparatus according to claim 33, wherein:

the electrode does not contact the print medium when the plasma generator is generating the plasma.

* * * * *